US010953313B2

(12) United States Patent
Schultze

(10) Patent No.: US 10,953,313 B2
(45) Date of Patent: Mar. 23, 2021

(54) THREE-DIMENSIONAL (3D), EXTENSIBLE GAMING PLATFORM AND MULTIPLAYER STRATEGY GAMES

(71) Applicant: GRIDOPOLIS GAMES, LLC, Santa Monica, CA (US)

(72) Inventor: Dave Schultze, Santa Monica, CA (US)

(73) Assignee: GRIDOPOLIS GAMES, LLC, Santa Monica, CA (US)

( * ) Notice: Subject to any disclaimer, the term of this patent is extended or adjusted under 35 U.S.C. 154(b) by 0 days.

(21) Appl. No.: 16/366,993

(22) Filed: Mar. 27, 2019

(65) Prior Publication Data

US 2019/0299086 A1 Oct. 3, 2019

Related U.S. Application Data

(60) Provisional application No. 62/649,137, filed on Mar. 28, 2018.

(51) Int. Cl.
*A63F 3/00* (2006.01)

(52) U.S. Cl.
CPC .. *A63F 3/00214* (2013.01); *A63F 2003/0022* (2013.01)

(58) Field of Classification Search
CPC ..... A63F 3/00214–2003/0022; A63F 2003/00359–00391; A63F 2003/00394; A63F 2003/004; A63F 2003/0046; A63F 2003/00574; A63F 2003/00583; A63F 2003/00593; A63F 2003/00599; A63F 3/00583–00608; A63F 3/00867–00876; A63H 33/10–101
USPC ..... 273/241
See application file for complete search history.

(56) References Cited

U.S. PATENT DOCUMENTS 3,767,201 A * 10/1973 Harper ..... A63F 3/00214 273/241
3,879,040 A 4/1975 Smith
4,133,537 A 1/1979 Chappell
4,571,200 A * 2/1986 Serna ..... A63H 33/105 446/111
5,033,751 A * 7/1991 Ching ..... A63F 3/00214 273/241

(Continued)

OTHER PUBLICATIONS

"Nexo Knights Chess Set 1" by Lyichir, www.flickr.com/photos/71476500@N08/27684915830/in/photostream, uploaded Jun. 28, 2016 (Year: 2016).*

(Continued)

*Primary Examiner* — Laura Davison
(74) *Attorney, Agent, or Firm* — Risso I.P.

(57) ABSTRACT

This three-dimensional (3D) gaming platform provides snap-together construction components and designs for building a variety of custom, multi-level game boards (grid-sets) on which players (one or more) can play a wide variety of included and extensible logic and strategy games. The invention includes sets of player pieces as well as custom "node" components that modify the behavior of spaces on the grid-set. Players may use additional grid-set construction parts and nodes to modify the physical board during play. The gaming platform enables an extensible variety of games as well as opportunities for further customizing grid-sets, game types, player pieces, 3D printable extensions, and virtual digital implementations.

3 Claims, 36 Drawing Sheets

(56) References Cited

U.S. PATENT DOCUMENTS

| | | | | | |
|---|---|---|---|---|---|
| 5,048,840 | A * | 9/1991 | Johnson, Jr. | A63F 3/00214 | 273/241 |
| 5,100,149 | A * | 3/1992 | Olfman | A63F 3/00214 | 273/241 |
| 5,195,750 | A * | 3/1993 | Courialis | A63F 3/00214 | 273/241 |
| 5,435,570 | A | 7/1995 | Labrasseur | | |
| 5,456,472 | A * | 10/1995 | Goodman | A63F 3/00214 | 273/241 |
| 5,647,594 | A * | 7/1997 | Pesquie | A63F 3/00261 | 273/282.1 |
| 5,871,212 | A * | 2/1999 | Lee | A63F 3/02 | 273/283 |
| 6,062,978 | A | 5/2000 | Martine et al. | | |
| 6,645,070 | B2 | 11/2003 | Lupo | | |
| 2005/0035546 | A1* | 2/2005 | Tarrano | A63F 3/02 | 273/261 |
| 2006/0175754 | A1 | 8/2006 | Eggers | | |
| 2007/0296149 | A1 | 12/2007 | Hughes | | |
| 2008/0012220 | A1* | 1/2008 | O'Neill | A63F 3/02 | 273/236 |
| 2010/0276882 | A1* | 11/2010 | Natson | A63F 3/0023 | 273/241 |
| 2011/0127720 | A1 | 6/2011 | Fourcell | | |

OTHER PUBLICATIONS

Written Opinion of the International Search Authority for US/2019/024419, dated Jul. 11, 2019.

* cited by examiner

100

GAME #1

MATRIX

QUICK START GUIDE

| PLAY TIME | AGES | PLAYERS |
|---|---|---|
| 20-60 MINUTES | 8+ | 2-4 OR MORE! |

QUICK START OVERVIEW

OBJECTIVE

The goal of Gridopolis is to capture your opponents until you are the last one left or time runs out. You capture others by jumping over them.

If you have ever played checkers or chess, you get the idea.

Only now, we are playing in 3D

That means you can move and jump and play in any direction!

You can move horizontally, vertically, and diagonally – and across multiple levels. Unlike any other games, the grid-set * is dynamic and changes during play.

* The *grid-set* is your 3D playing arena.

Any marker that gets jumped is captured and comes out of the game. Use a multi-jump to capture more than one opponent on a single turn!

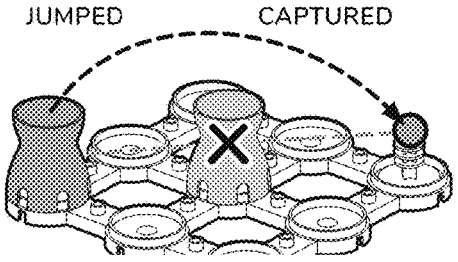

THREE POINTS = STRAIGHT LINE

JUMPING in 3D

Any jump-capture move must follow the 'straight-line' rule.

Think of three points (or pads) in a row: your starting point, the opponent you are jumping over, and your landing point.

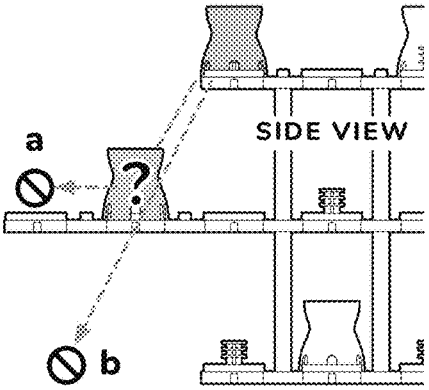

NOT ALLOWED: These two illegal jumps require (a) turning or (b) landing where there is no pad.

OTHER MOVES

A *hyper-pad* is a special pad. Land on one to get 'beamed' to any other hyper-pad on the grid-set. It's still one turn.

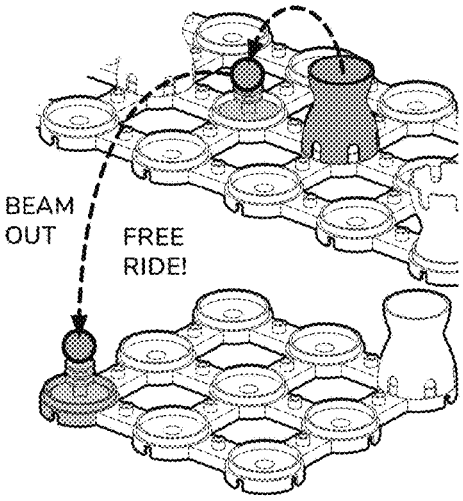

FIG. 16

QUICK START (CONTINUED)

The *kamikaze* move allows you to play outside the grid-set. If you have nowhere to land when jumping, you can still capture an opponent with this sacrifice move. Both markers must be on the same level and both are removed.

MOVE OR BUILD

At the beginning of a game, each player gets ten extra grid-set parts. These can be used to change the grid-set in the middle of a game!

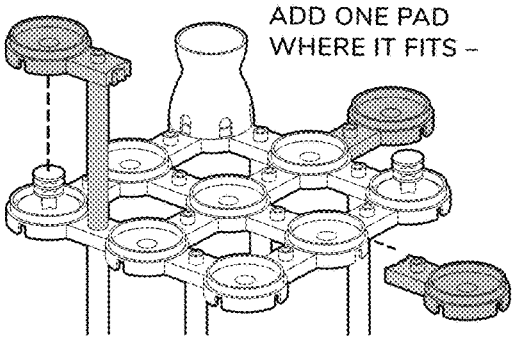

Grow the grid-set with the add-a-pad move.

Or, shrink the grid-set with the *blocker-box* move. The pad is out of order for the rest of the game.

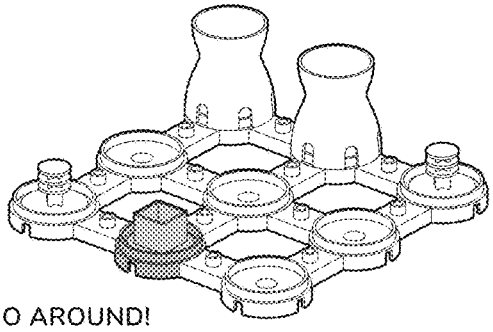

SO MUCH MORE!

This is just the first game in the Gridopolis Game System. You can also change the layout of the grid-set, tweak the rules, add new parts, and even create your own original game from scratch. Wow.

FIG. 17

PARTS + DEFINITIONS

BUILDING PARTS

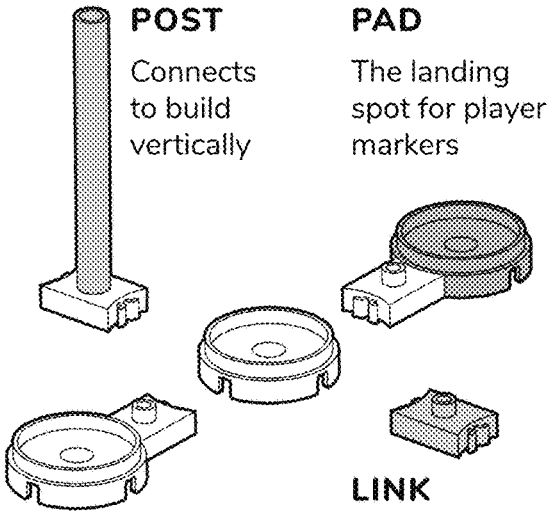

POST

Connects to build vertically

PAD

The landing spot for player markers

LINK

Connects to any pad or post

The Gridopolis system is built with three simple pieces that connect together. The pad and link connect horizontally, and the post connects vertically.

NODE PARTS

The nodes modify the normal pads so that they do something extra or special.

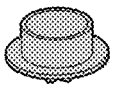

KINGERIZER

Used to mark your starting 'home-row.' Opponents try to land here to get 'kinged.'

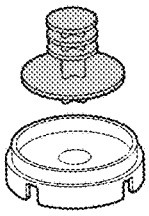

HYPER-PAD

This turns any pad into a wormhole – and beams your marker to any other hyper-pad.

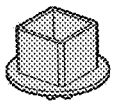

BLOCKER-BOX

Boom! Take a pad out of action for the rest of the game.

MARKERS

Each player has game markers to move and jump.

KING

Markers turn into kings when they reach their goal.

PAWN

All markers start out as pawns.

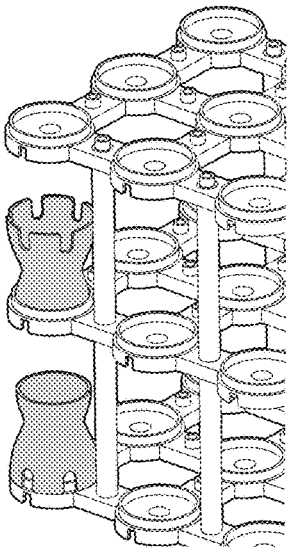

GRID-SET

Your three dimensional playing area is called a 'grid-set.' It's the structure where everything happens. It's defined for the start of a game – but can change during play!

FIG. 18

BUILDING a GRID-SET

ASSEMBLY TIPS

Start by connecting the links to the pads. They're easier to connect if you attach them from the underside.

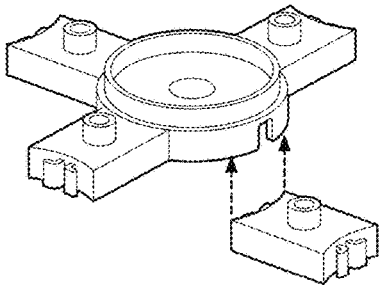

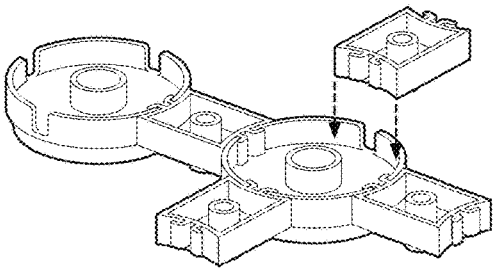

Or – just turn stuff upside down!

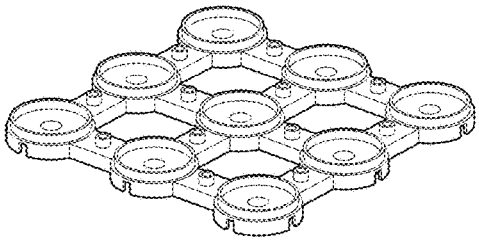

When building a 3D level, it's a lot easier to build a full horizontal 'floor' first.

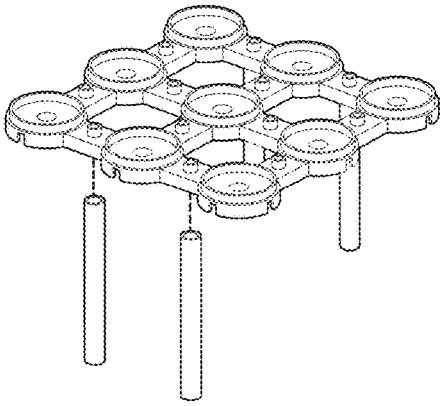

Next, connect the posts to the underside of the links.

Finally, lower each floor and post assembly on to the floor level below.

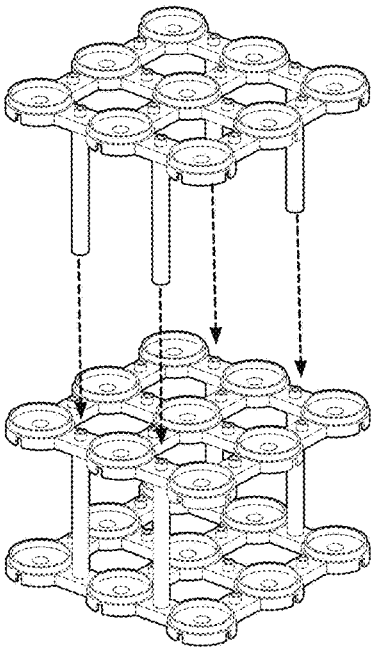

Each post fits on a link below.

FIG. 19

GAME SET-UP for MATRIX

GET STARTED!

Each player gets the following ten parts before the game starts. Set them aside for later use.

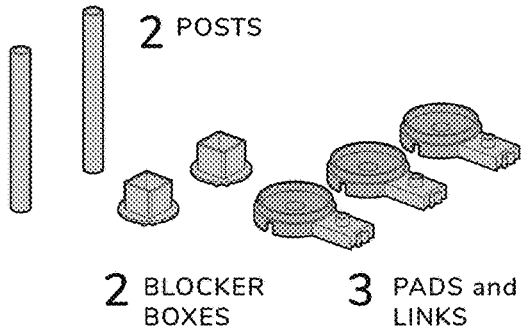

BUILD YOUR GRID-SET

Build three levels and then add four supporting posts for each level.

Place hyper-pads as shown, five total.

Place kingerizers in a *single* back 'home-row' for each player with matching colors, for three total.

For the 3- or 4-player option, add an extra set of six pads for each player.

2-PLAYER

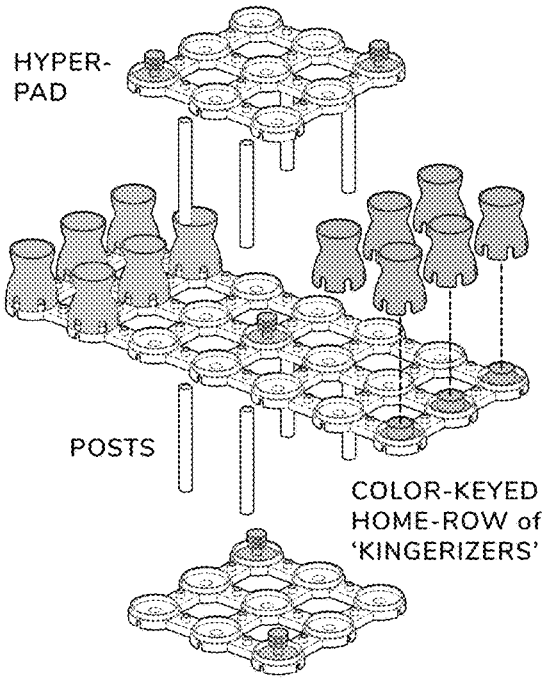

3- or 4-PLAYER

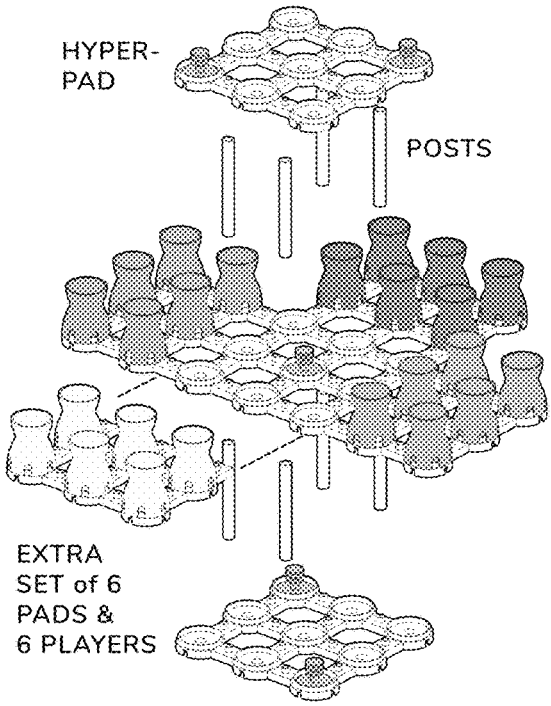

FIG. 20

WINNING!

OPTION 1

Be the last marker standing!
No time limit.

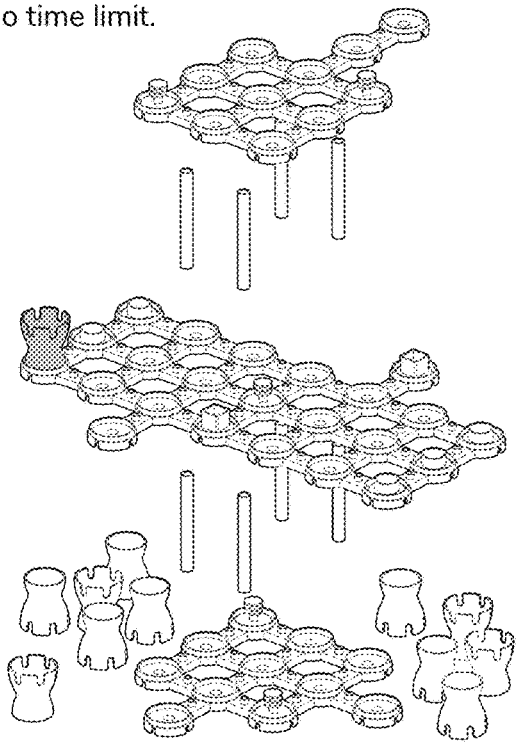

OPTION 2

Play to any time limit you choose.

Make sure that each person has the same number of turns. So, whoever went first, continue until right before it's that first person's turn.

Then count up all the markers you have left and the ones you have captured.

POINT SYSTEM

Kings you captured ..... 4 points
Pawns you captured ..... 3 points

Kings you have left ..... 2 points
Pawns you have left ..... 1 point

For the kamikaze move (explained later) give your own sacrificed marker, including points, to the opponent you captured. Keep their marker and points.

GAME PRE-CAP

Whenever it's your turn to move, you have *lots of options*!

- Move your marker in *any direction** – including up, down, and diagonally across multiple levels. It's 3D!
- Jump and capture any opponent.
- Jump and capture *multiple* opponents, with the *multi-jump* move.
- Land on a *hyper-pad* and 'beam-out' to any other hyper-pad!
- Capture an opponent, but land *outside* the grid-set with a *kamikaze* move.
- Use *add-a-pad*, and grow the grid-set for more playing room!
- Use the *blocker-box*, and shrink the grid-set by knocking a pad 'off-line.'

* At the start of games, 'pawn' markers cannot move backwards / towards their starting 'home-row.'

FIG. 21

MOVING: THE BASICS

STARTING

Pawns can move one pad at a time in any direction. This includes diagonally, sideways, and from one level to another. But, they can never go backwards – towards their home-row.

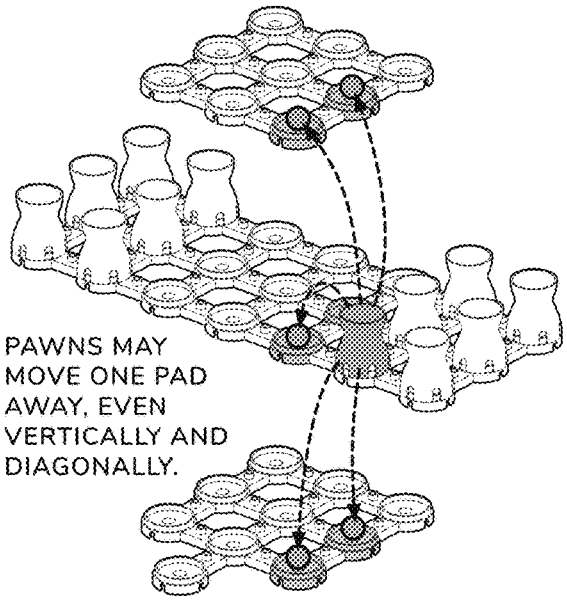

ALL 6 MOVES SHOWN IN ORANGE ARE LEGAL.

...LATER

Pawns can also jump their own team to speed things up! All jumps are required to be in a straight line – so no turning corners. You may even jump multiple markers on the same move. Orange pads highlight legal moves.

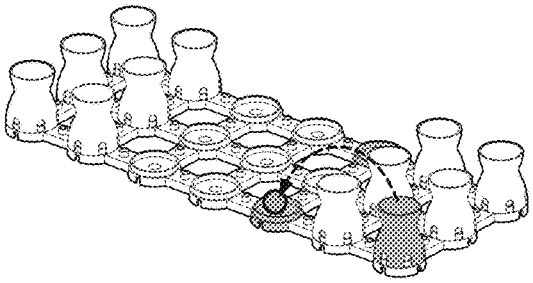

Sideways moving is OK, except for the home-row. Markers must exit.

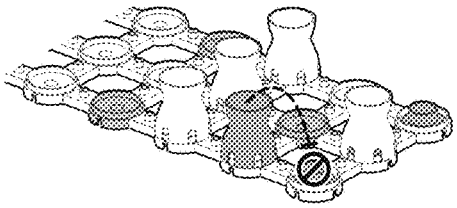

Pawns can never go backwards, which is towards their starting home-row.

... and AS A KING

Once you land on any opponent's home-row (the color-keyed kingerizer) you get kinged! Flip over your pawn – and it's now a king. This is a major advantage.

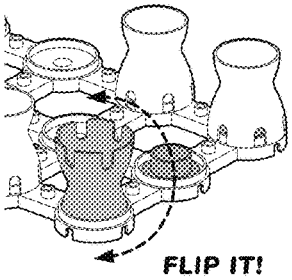

Why? Kings can then move one pad in any direction – but they also get two separate moves in a row. The second move is always optional.

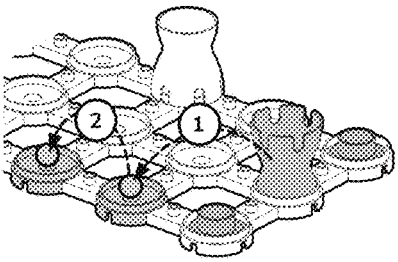

IT'S NOT TURNING. IT'S TWO MOVES!

FIG. 22

MOVING: NEXT STEPS

HYPER-PAD

Placed on the grid-set before play, a hyper-pad is a special pad 'node.' Any marker landing on it will beam out – to any other open hyper-pad – of your choosing. This travel does not count as an extra move.

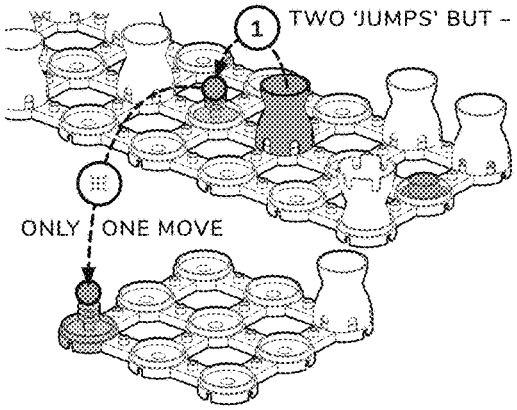

When landing on a hyperpad, you must beam out, unless all other hyper-pads are occupied. In that case, stay put. Pawns are not subject to the 'moving backwards' rule – any hyper-pad is allowed!

BLOCKER BOX

A blocker box will eliminate any pad it's placed on. (Its nickname is 'little box of dynamite.') Once placed, it cannot be moved and *all players* must go around for the remainder of the game. *It is used in lieu of a move.*

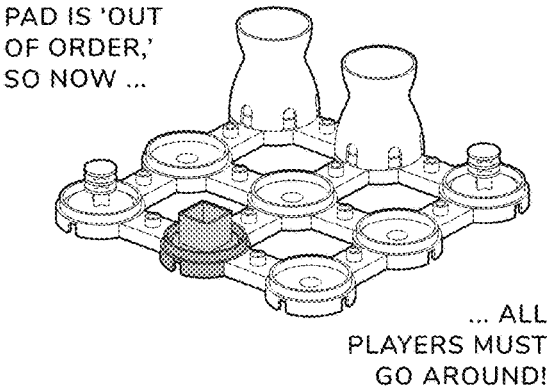

Each player gets two blocker boxes at the beginning of the game and can use them at any time. They can be placed on any *open pad* (which is *not* occupied by a kingerizer, hyperpad, or player marker.)

ADD-A-PAD

The grid-set you start with is *not* the one you end with! A new pad can be connected anywhere it fits, either horizontally or vertically.
*It is used in lieu of a move.*

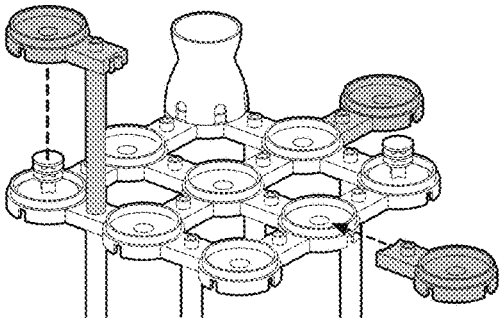

Each player gets three pads + two posts at the beginning of the game and can use them at any time. When using a post, the new pad must be *directly above* another pad.

FIG. 23

CAPTURING

JUMPING 101

To capture a marker, you jump over them – *in a straight line* – into an empty pad. Both pawns and kings can capture each other, but pawns cannot go backwards at any time.

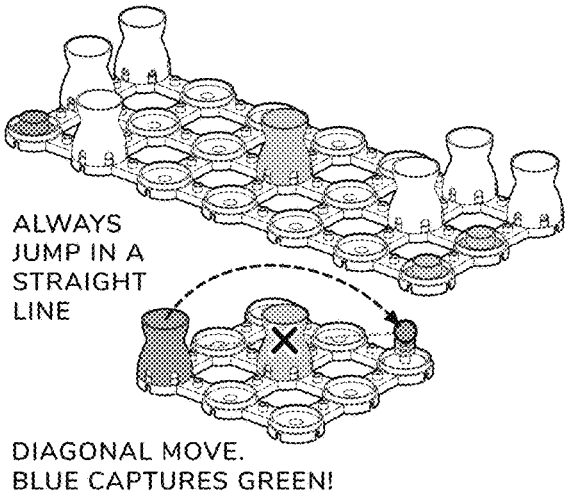

Captured markers are *always removed* from the grid-set.

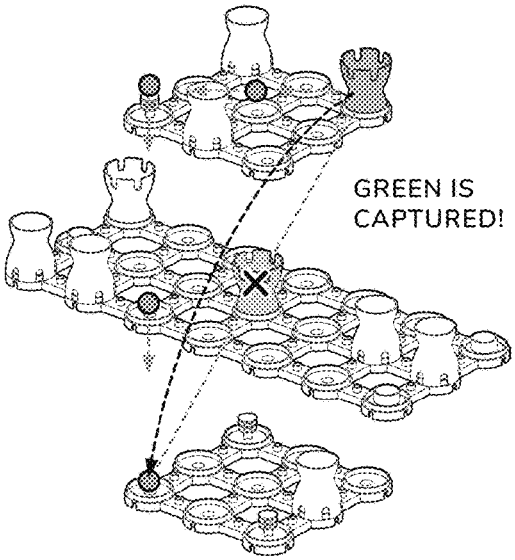

JUMPING 102

Any capture-jump-move must *always* be made in *a straight line,* with no turns or changes in direction. This is tricky with different levels and diagonal angles.

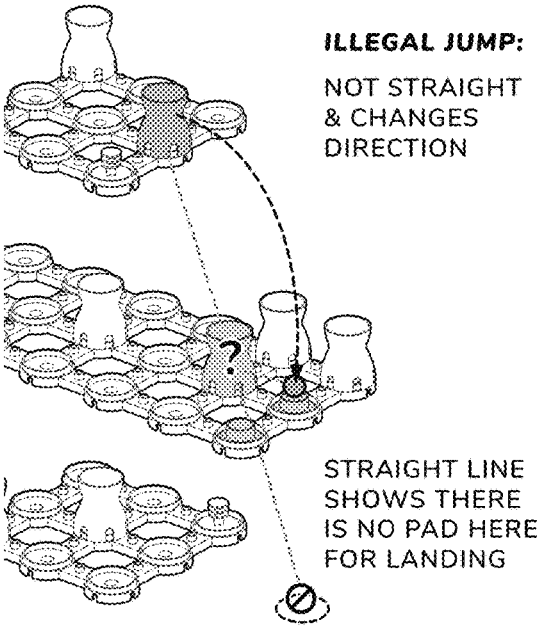

A diagonal *with* multi-level jump is challenging for some players to visualize. It can help to first imagine the move on a single level.

FIG. 24

CAPTURING

The straight-line capturing requirement is the most confusing rule for beginners.

Here is the same illegal jump from the top and side views to help illustrate.

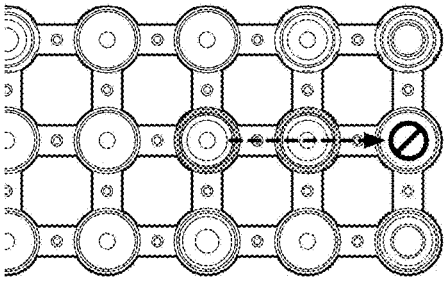

TOP VIEW

Looks OK from this angle – but it's not.

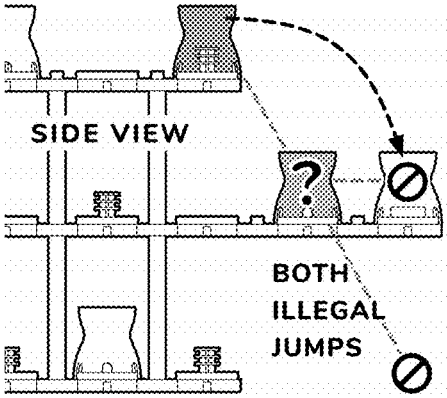

The planned jump-move requires a turn – or landing where there is no pad.

KAMIKAZE!

This 'sacrifice' move is when a player captures an opponent's marker, but lands off the boardset! Both markers are eliminated from play.

The kamikaze can only be used to jump an opponent on the same level. There is no limit to when, or how often, the move can be used.

MULTI-JUMP

Jumping is not only limited to capturing one marker. A multi-jump allows you to keep jumping and capture more!

NICE MOVE

BLUE CAPTURES THREE GREENS IN ONE MOVE!

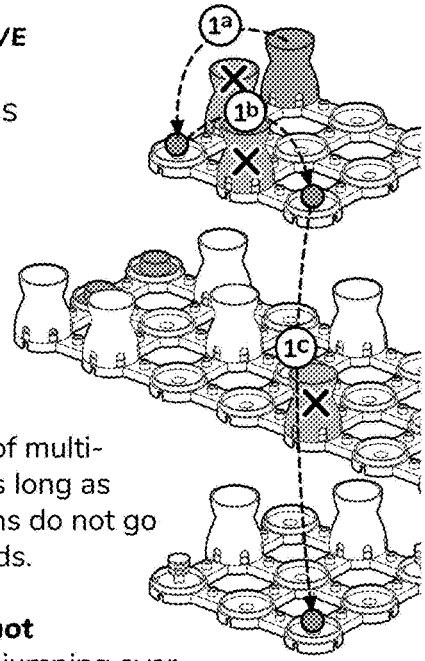

There is no limit to the amount of multi-jumps, as long as the pawns do not go backwards.

You cannot combine jumping over your own markers and capturing an opponent.

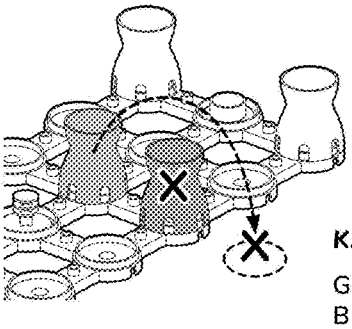

KAMIKAZE!

GREEN & BLUE BOTH REMOVED

If playing a timed game, the markers and points are divided:

- Green captures – and keeps – blue.
- Green is given to blue opponent.

FIG. 25

ADDITIONAL TIPS

HYPER-PAD TIPS

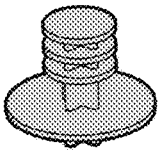

Hyper-pads do not count as part of your 'move.' If you land on one, the next jump is free!

When you land on a hyper-pad, you must 'beam-out' to any other un-occupied hyper-pad. Pawns are not resticted by direction.

If you land on a hyper-pad when all other hyper-pads are blocked with markers ('fully-corked') then you stay on that hyper-pad with no 'beam-out.'

After you arrive at your destination hyper-pad, you will need to leave that hyper-pad and re-enter (or land on another hyper-pad) to 'beam-out' again.

Since kings have two moves, they can use move #1 to exit and then move #2 to re-enter and 'beam out.'

KING JUMPING

With a king's ability to move in *any direction*, you may have more jumps than you think.

Although rare, a king may be able to capture three – or even four – opponents in one single move. Impressive!

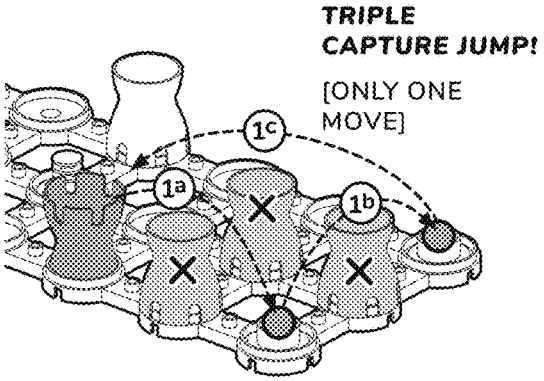

BLUE MOVE #1 [a,b,c]
CAPTURES 3 GREEN
ALL ARE REMOVED

[OPTIONAL MOVE #2 REMAINING]

By using a hyper-pad on their *first move*, a king can still take a second move *after they arrive* at the destination hyper-pad.

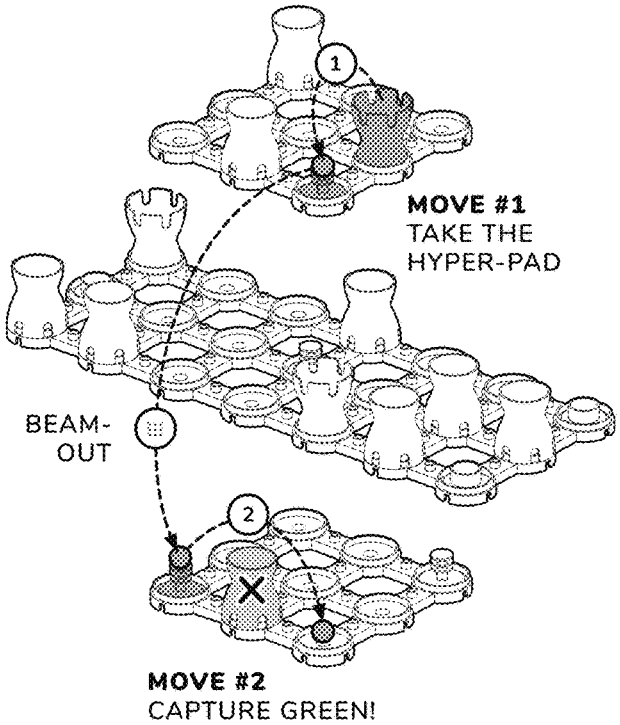

FIG. 26

OTHER WAYS TO PLAY

MORE DESIGNS

The grid-set in this manual is just a starting point. Have an idea for your own design? Try it out!

Matrix is incredibly flexible and modular. Modify the grid-set and test out new designs at any time.

The rules are also totally flexible. As long as all players agree, feel free to tweak and test. Share your best inventions at the Gridopolis website!

MORE PLAYERS

This manual shows how two to four people can play together. But – that is not the limit!

As long as the markers are different colors, you can keep adding more players. Check out the Gridopolis website for extra parts and extension sets.

'MATRIX : FOUR TOWERS'

SAME GAME / NEW GRIDSET!

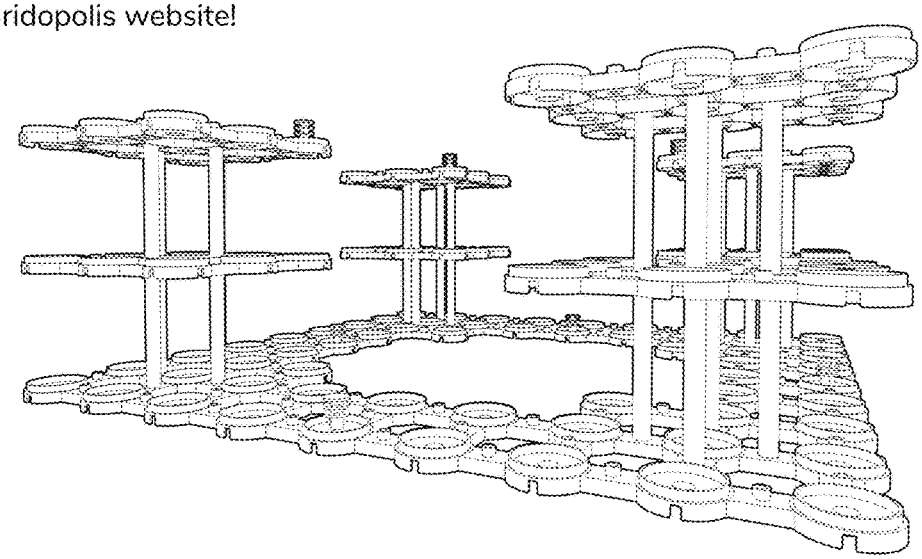

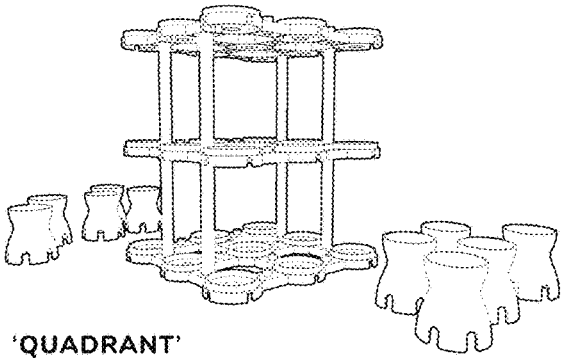

'QUADRANT'

SAME PARTS / ALL NEW GAME!

MORE GAMES

Matrix is just the first of many more games in the Gridopolis Game System. You use the exact same parts, re-arrange them, and start playing brand new games. No purchase required!

Want even more? Stay tuned for STEM guidelines and lesson plans to help design your own original game from scratch.

FIG. 27

Twisted Tower

Fast-paced, two-player action with vertical gameplay!

GRIDSET BLUEPRINT 01

PLAY TIME 10-20 MINUTES

AGES 6+

PLAYERS 2

GRIDOPOLIS IS BOTH A GAME AND AN EXPANDABLE SYSTEM.

Using the same rules you already know, this GridSet Blueprint allows you play a whole new configuration.

PARTS REQUIRED

You're covered!

The Twisted Tower is built entirely with parts included in the Gridopolis starter set.

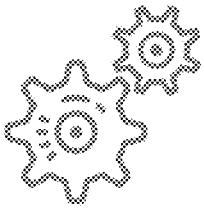

No extra parts are required!

Grid-Set Parts

Using these parts, build the GridSet, starting with STEP 1 on PAGE 3.

102 PARTS

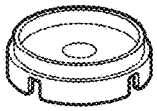

36 Pads

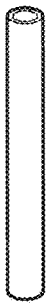

12 Posts

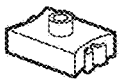

36 Links

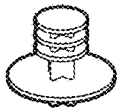

4 Hyper-pads

Player Building Parts

Each player gets these ten parts, but they are kept separate from the Grid-Set until used.

10 EACH

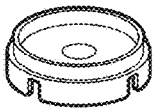

3 Pads

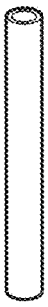

2 Posts

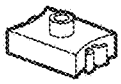

3 Links

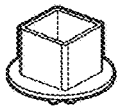

2 Blocker-Boxes

Game Parts

These seven parts are placed on the grid-set.

7 EACH

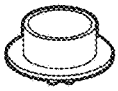

3 Kingerizers

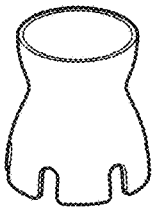

4 Markers

FIG. 29

GETTING STARTED

RULE REMINDERS

These reminders are greatly abbreviated.

If you would like more information, refer to the Instructions or Quick Start available online or in your original box.

GAME OBJECTIVE

The goal of Gridopolis is to capture your opponents until you are the last one left or time runs out. You capture others by jumping over them.

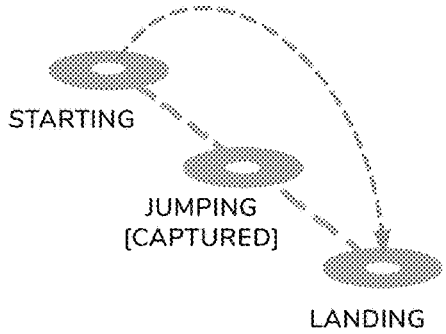

Check out this simplified jump-capture diagram. It works the same in any direction or angle, even when crossing multiple levels.

Any marker that gets jumped over is captured and comes out of the game.

JUMPING in 2D

Any jump-capture move must follow the '*straight-line rule.*' Think of three points (or pads) in a row: your *starting* point, the opponent's pad you are *jumping* over, and your *landing* pad.

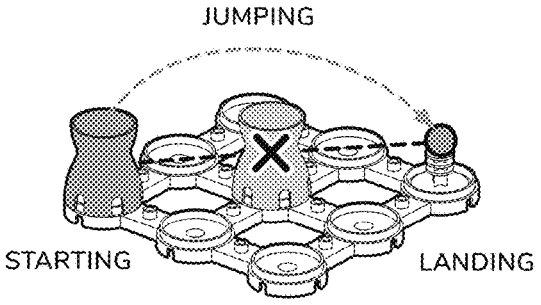

JUMPING in 3D

Jumping in 3D is trickier, but it *always* uses the exact same '*straight-line rule.*'

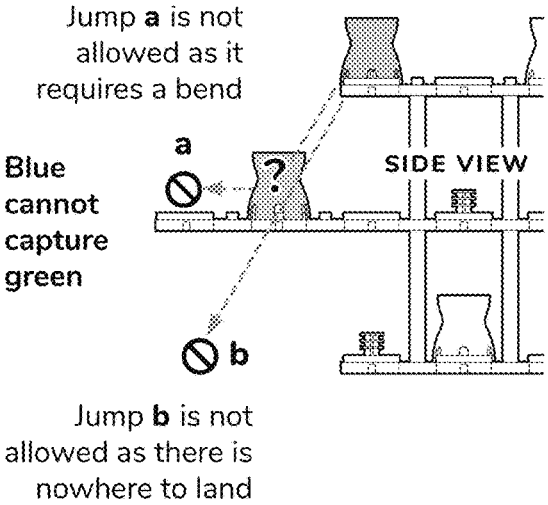

FIG. 30

CONSTRUCTION
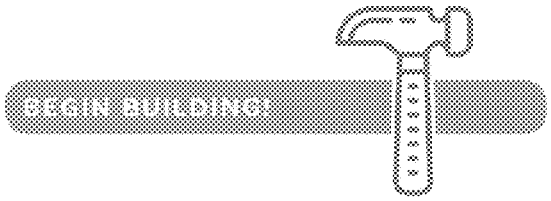
STEP 1
Build six identical floors. Keep them separate until STEP 3.
Each floor has
6 pads + 6 links
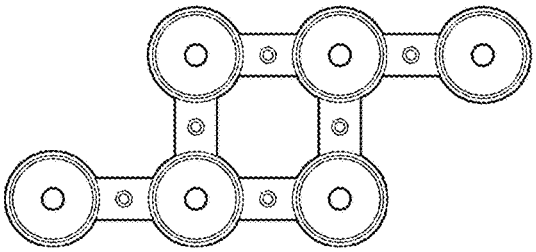
STEP 2
Connect four posts to the center four links. Only the first floor has four posts; all other floors have two.
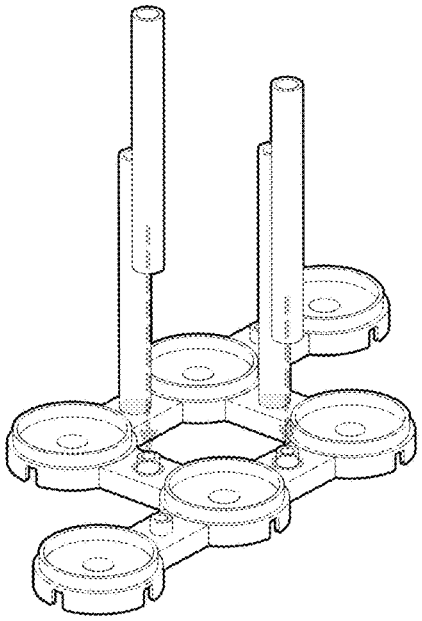
FIG. 31

CONSTRUCTION
STEP 3
Turn floor 2 by 90° (either way) and connect to floor 1.
Stack up the four center pads. Add two posts above.
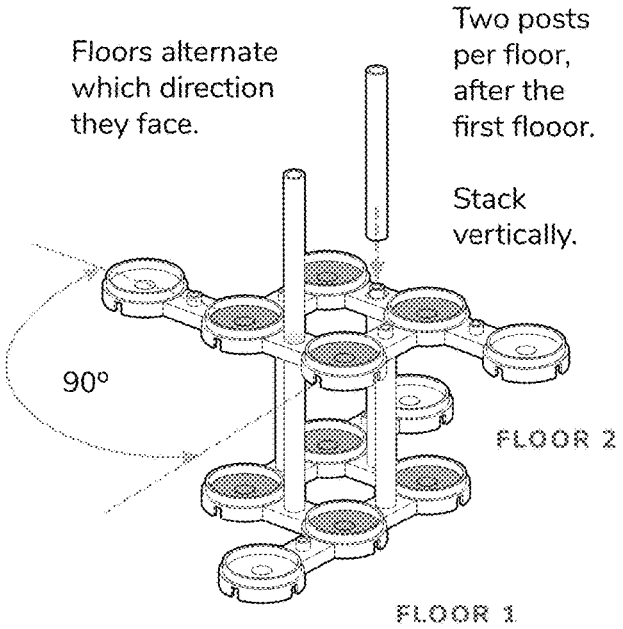
STEP 4
Connect floors 3 through 6 with alternating rotation as shown.
Use two posts each time and stack up.
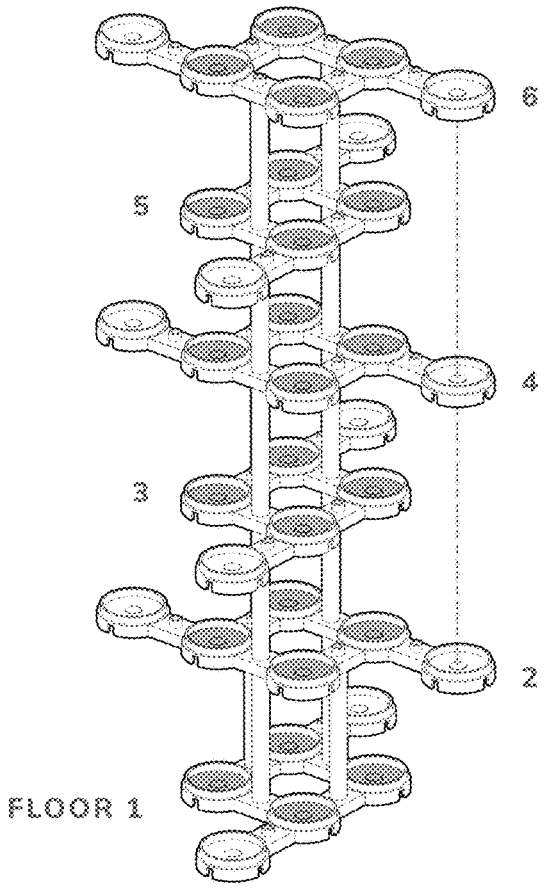
FIG. 32

GAME SET-UP
STEP 5
Place the three kingerizers at the top and bottom as shown.
Place four hyper-pads as shown.
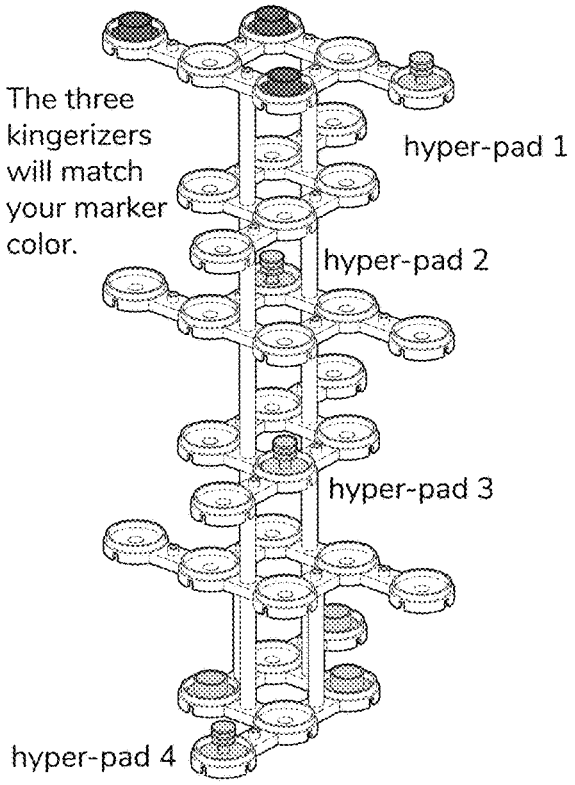
STEP 6
Place four markers on the top and bottom floors.
Match the kingerizer colors already there.
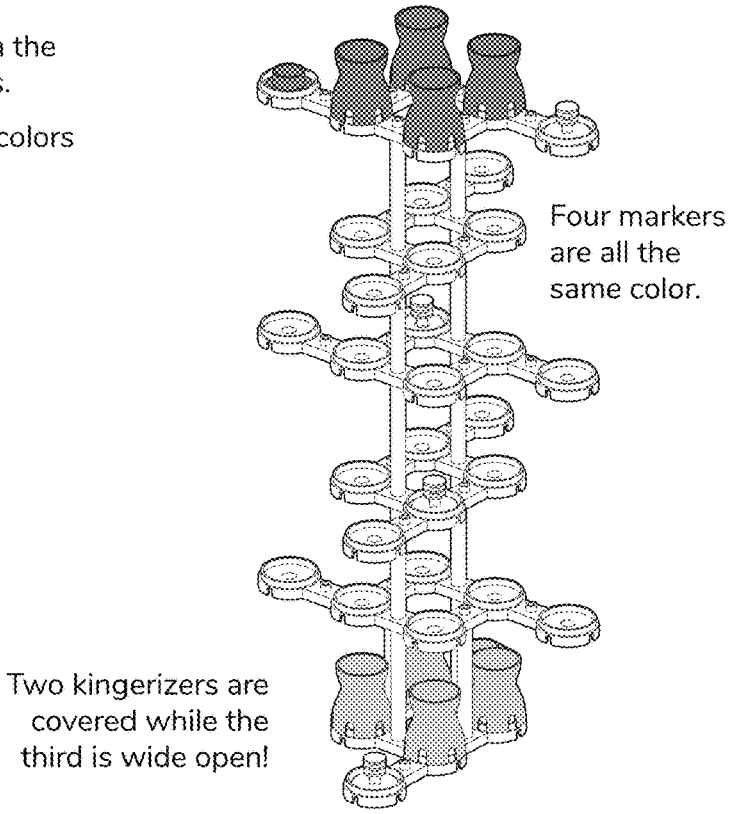
FIG. 33

GAME SET-UP
STEP 7
Pass out these ten extra parts for each player and start the game!
All rules are the same.
2 posts
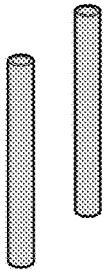
2 blocker boxes
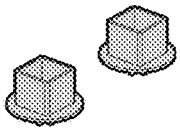
3 pads and links
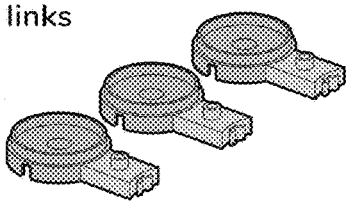
Start playing!
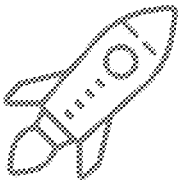
FIG. 34

THREE-DIMENSIONAL (3D), EXTENSIBLE GAMING PLATFORM AND MULTIPLAYER STRATEGY GAMES

CROSS-REFERENCE TO RELATED APPLICATIONS

The present application is a Non-Provisional Application of U.S. Provisional Application No. 62/649,137, filed on Mar. 28, 2018, entitled, "Three-dimensional (3D), extensible gaming platform and multiplayer strategy games," the entirety of which is incorporated herein by reference.

BACKGROUND OF THE INVENTION

(1) Field of Invention

This invention relates generally to board games and construction sets and, more specifically, to a three-dimensional and extensible gaming platform for multiplayer strategy games.

(2) Description of Related Art

Multiplayer games have long been known in the art and are typically directed to a two-dimensional board. For example, traditional multiplayer strategy games tend to employ fixed board layouts and game-play commences typically on a single plane on a predefined playing platform with a specific set of rules for play. While enjoyable and time consuming, such traditional strategy games do not allow for platform building or multi-dimensional play.

Thus, a continuing need exists for an extensible gaming platform that allows players to build and expand the platform throughout multiple dimensions and in such a manner to foster creativity and enhance enjoyment.

SUMMARY OF INVENTION

The present disclosure is directed to a three-dimensional (3D) gaming platform and game play associated with the gaming platform. The gaming platform includes a plurality of pads (each pad being formed to connect with a horizontally adjacent pad) and a plurality of posts (each post being formed to vertically connect at least two pads), thereby forming a grid-set.

In one aspect, each pad includes at least one pad connector component.

In yet another aspect, a plurality of links are included. Each link has a top and bottom post connector and at least two link connector components. The link connector components are formed to connect with a pad connector to horizontally affix a pad with a link.

In another aspect, each post is formed to connect with both a top post connector and a bottom post connector to vertically connect the at least two links and, in doing so, vertically connect the at least two pads when attached with a link.

In yet another aspect, a plurality of player markers are included. Each player marker is formed to reversibly attach with a pad.

In yet another aspect, a plurality of nodes are included. Each node is also formed to connect with a pad. The plurality of nodes include at least one blocker node; the blocker node being shaped and size to prevent a marker from sliding over the blocker node and rest upon a pad.

In another aspect, each pad is formed to have a nesting portion surrounded by a raised ridge, and further comprising a ledge such that the nesting portion and ledge are separated by the raised ridge.

In yet another aspect, each marker is formed to include a first end and a second end such that it can rest on the pad in two configurations, wherein in a first configuration, the first end slides over the raised ridge and rests upon the ledge, or wherein in a second configuration, the second side slides within the raised ridge and nests within the nesting portion.

In another aspect, a base is included that is formed to connect with a pad; the base having one or more figure connectors for securely affixing a figure with the base.

In yet another aspect, the present disclosure is directed to a method for playing a game using a three-dimensional gaming platform. The method includes several acts, such as constructing an initial grid-set to include at least a plurality of pads connected with one another; distributing to two or more players a plurality of structural components and a plurality of markers; placing, by the two or more players, the plurality of markers within the initial grid-set such that the plurality of markers are connected with one or more of the pads within the plurality of pads; adding to the grid-set, by at least one of the players, by connecting one or more additional pads to the plurality of pads such that at least two pads are vertically connected with one another and/or at least two other pads are horizontally connected with one another; and moving one or more markers across the grid set by moving the markers in at least one direction selected from a group consisting of vertically, horizontally, and diagonally (or all of those directions or any combination thereof). It should be noted that the acts are not necessarily performed in any specific order unless explicitly claimed otherwise. The plurality of structural components that are distributed include a plurality of pads, links, and posts. Further, the pads are connected with one another horizontally by a link connected horizontally between the pads, and wherein the pads are connected with one another vertically by a post vertically connecting two links.

In another aspect, the method includes an act of modifying game play associated with one or more pads by placing a modifier node on at least one pad. The modifier node includes one of a kingerizer node, a hyper-pad node, and blocker-box node.

Finally, as can be appreciated by those skilled in the art, the present invention also includes a method for forming and using the gaming platform as described herein, including performing all the game play acts and/or operations as described and/or illustrated and/or per the rules described and/or illustrated.

BRIEF DESCRIPTION OF THE DRAWINGS

Various detailed embodiments of the present inventions are illustrated as examples. Additional embodiments, forms, styles, and refinements are not limited solely to the figures of the accompanying drawings.

FIG. 16 is an illustration depicting rules and game play using the gaming platform according to various embodiments of the present invention;

FIG. 17 is an illustration depicting rules and example game play using the gaming platform according to various embodiments of the present invention;

FIG. 18 is an illustration depicting rules and example game play using the gaming platform according to various embodiments of the present invention;

FIG. 19 is an illustration depicting rules and game play using the gaming platform according to various embodiments of the present invention;

FIG. 20 is an illustration depicting rules and example game play using the gaming platform according to various embodiments of the present invention;

FIG. 21 is an illustration depicting rules and example game play using the gaming platform according to various embodiments of the present invention;

FIG. 22 is an illustration depicting rules and game play using the gaming platform according to various embodiments of the present invention;

FIG. 23 is an illustration depicting rules and example game play using the gaming platform according to various embodiments of the present invention;

FIG. 24 is an illustration depicting rules and example game play using the gaming platform according to various embodiments of the present invention;

FIG. 25 is an illustration depicting rules and game play using the gaming platform according to various embodiments of the present invention;

FIG. 26 is an illustration depicting rules and game play using the gaming platform according to various embodiments of the present invention;

FIG. 27 is an illustration depicting rules and game play using the gaming platform according to various embodiments of the present invention;

FIG. 29 is an illustration depicting rules and example game play using the gaming platform according to various embodiments of the present invention;

FIG. 30 is an illustration depicting rules and game play using the gaming platform according to various embodiments of the present invention; and FIGS. 31 through 34 include additional illustrations depicting rules and game play using the gaming platform according to various embodiments of the present invention.

DETAILED DESCRIPTION

Figure 1:
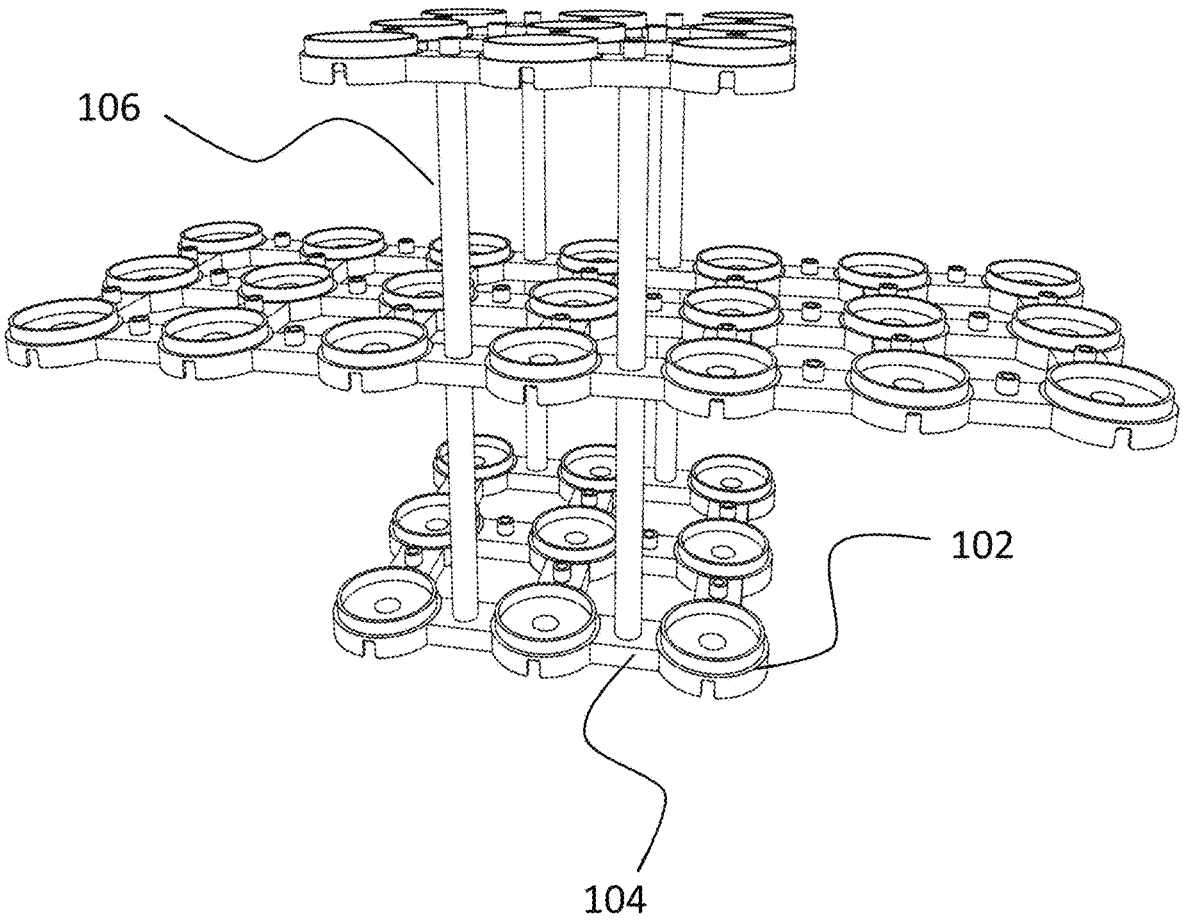
FIG. 1 is a side-view illustration of gaming platform according to various embodiments of the present invention, depicting gaming platform assembled as a "grid-set" game board configuration.

The present disclosure is directed to board games and construction sets and, more specifically, to a three-dimensional and extensible gaming platform for multiplayer strategy games. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Provided below is a brief introduction followed by specific details.

(1) Introduction

The present disclosure is directed to a three-dimensional (3D) and extensible gaming platform. This 3D gaming platform borrows some familiar game concepts from game titles such as Checkers and Chess, with familiar game-play actions (such as jumping) to capture opponents and player game pieces of pawns and kings. This gaming system, however, puts a spin on traditional gaming with a unique and extensible 'snap-together,' multi-level, 3D platform (grid-set) that can be modified during game-play and supports single and multiple players for a variety of different game types as well as player-inspired games and other separately packaged game extensions. This invention extends familiar game play options by adding the third dimension of play with custom player-configurable board layouts that can be modified and extended during game play. This creates a highly extensible game playing platform that can vary from a simple single plane 'board-set' to complex multi-level, 3D board-sets which can also be modified during the game.

The gaming platform includes sets of simple snap-together structural parts that provide an additional element of construction play and creativity that is lacking in most traditional board games. The snap-together component construction aspect of this gaming platform allows for additional game extensions and expansion kits, similar to boxed kits of construction blocks or other construction toys. Players can build pre-packaged designs or create and build their own 3D grid-sets. The connectable structural components easily connect horizontally and vertically and allow a wide variety of three-dimensional, multi-level construction options for physical (or virtual) board layouts. Players can construct and build their own 3D gaming platforms (grid-sets) to enhance gameplay and create new multiplayer gaming experiences. Thus, extra structural parts and board position modifiers can be placed on the grid-set to modify the gaming platform before and/or during play.

Additionally, and in various aspects, sets of unique player markers allow for multiple players. Further, board position placeholder "nodes" add special modified behavior to board locations. Player markers can move in three dimensions as well as special case movements to other grid-sets or non-contiguous locations. In other words, the gaming platform provides user-configurable board sets that can be extended with numerous add-on options, characters, and rules to create fresh, new, and unique gaming options.

The invention can scale considerably from simple single player puzzle and logic games to small, medium, and very large-scale, complex multiplayer, distributed games. In doing so, the invention can support a wide variety of ages, ability levels and game play. A variety of games and applications can be played on these highly extensible and scalable grid-sets. Several non-limiting examples of suitable embodiments include analog (physical) construction sets, digital game interfaces and editors, crowdsourced game designs and rules, and educational applications for creative learning. Specific details regarding the gaming platform are provided below.

(2) Specific Details

As noted above and as shown in FIG. 1, the present disclosure is directed to 3D gaming platform that is an extensible 3D board game construction system that functions as a dynamic gaming platform for a variety of single and multiplayer strategy and logic games. The gaming platform includes a variety of components as described in further detail below. Notably, the components can be assembled to form a "grid-set" 100 as illustrated in FIG. 1. The grid-set 100 operates as an initial 3D structural game board and allows a wide variety of three-dimensional, multi-level construction options for physical (or virtual) board configurations.

The grid-set 100 is formed of any suitable component parts that can be easily assembled by a player to form such a 3D board game. As a non-limiting example and as shown in FIG. 1, the grid-set 100 is constructed of structural pads 102, links 104 and posts 106. The component parts operate as snap-together board construction component parts that easily connect in combination horizontally and vertically to collectively form the grid-set 100.

Figure 2:
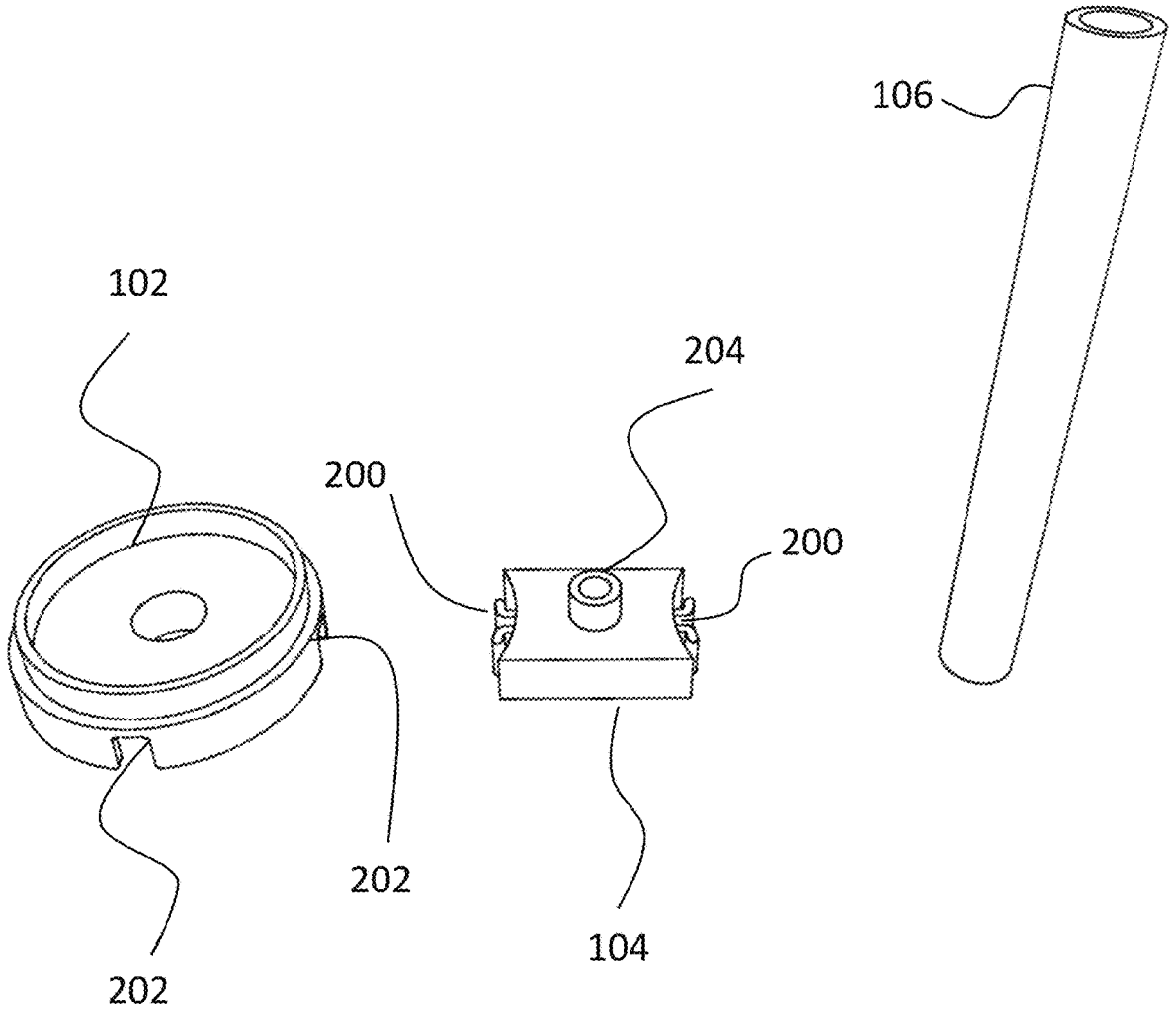
FIG. 2 is an elevated, side-view illustration of component parts as used for grid-set construction according to various embodiments of the present invention, including a pad, link and post.

The structural component parts are further illustrated in FIG. 2. As shown, the "pad" 102 identifies a single playable position and functions as a primary structural element. It should be noted that although the pad 102 is desirably formed as a circular pad, the invention is not intended to be limited thereto as the pad 102 can be formed in any suitable shape to provide both structural and play elements.

The "link" 104 is operable for connecting pads 102 horizontally. In this aspect, the link 104 includes one or more link connector portions 200 that are formed to easily connect with a corresponding pad connector portion 202 formed on a pad 102. The link and pad connector portions 200 and 202 are formed in any suitable shape to allow for easy attachment/detachment therebetween. As a non-limiting example, the link connector portions 200 are formed as tabs while the pad connector portions 202 are formed as notches to easily and securely engage with the tabs. While not limited thereto, it should be noted that the pads 102 desirably include at least four pad connector portions 202 (formed equidistance around the perimeter of the pad 102) while the links 104 desirably include at least two link connector portions 200 (formed opposite one another). It should be noted that although the pads 102 are illustrated with four pad connector portions 202 (allowing for a grid-set with a 90-degree angled structural system), the invention is not intended to be limited thereto as the pads 102 can have any number of connector portions for linking with the relevant part. For example, there could be three (3) or six (6) connection points on each pad 102. In this example, this would result in a grid-set that has a 60-degree or a 120-degree angled structural system.

Also depicted is a post 106. The posts 106 are used to link pieces vertically and provide vertical support to physical and 3D board levels. The posts 106 are formed of any suitable shape to vertically link the pieces. As a non-limiting example, the posts 106 are cylindrical-shaped sleeves and are formed to securely affix (e.g., slide over) with a post connector 204 (e.g., protrusion) formed on the links 104.

Figure 3A:
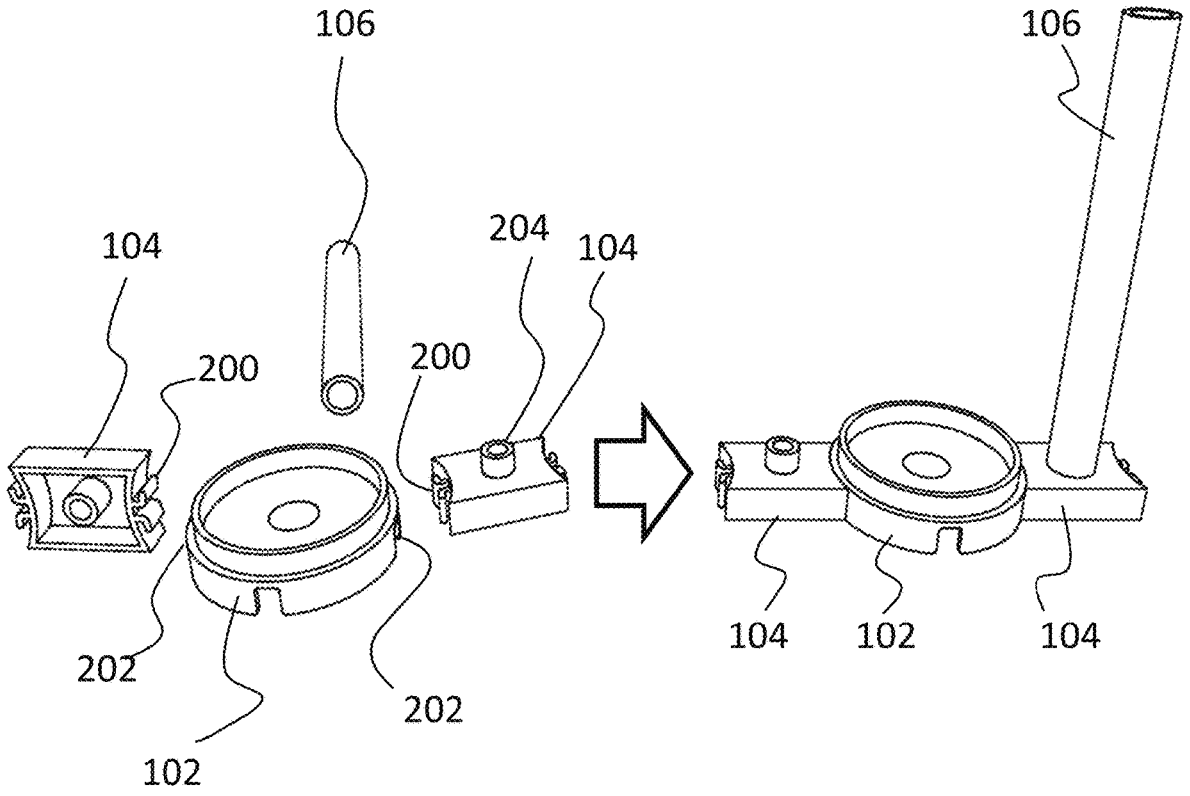
FIG. 3A is an elevated, side-view illustration depicting the component parts being assembled with one another, according to various embodiments of the present invention.
Figure 3B:
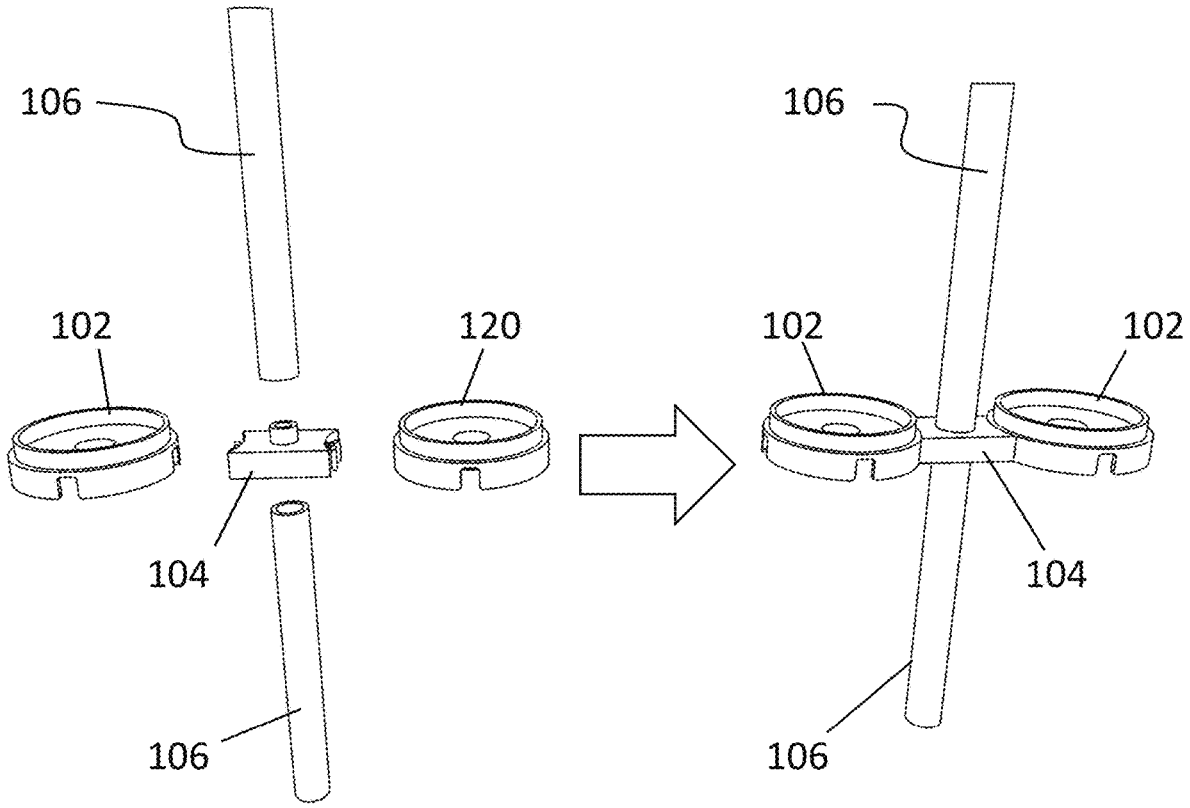
FIG. 3B is an elevated, side-view illustration depicting a pad, link, and post being assembled with one another, according to various embodiments of the present invention.

For example, and as shown in FIGS. 3A and 3B, the three structural parts snap together in various configurations to provide the physical "grid-set" board structure of multi-level playing surfaces. These three, unique structural elements (i.e., the pad 102, link 104, and posts 106) are designed such that the connections are sufficiently strong in order to physically support multiple levels of construction as well as player pieces. In this example and as depicted, the pad connector portions 202 are attached with corresponding link connector portions 200 to securely affix the pad 102 with the links 104. Further, the post 106 is connected with the post connector 204 to securely affix the post 106 with one of the links 104.

Figure 4A:
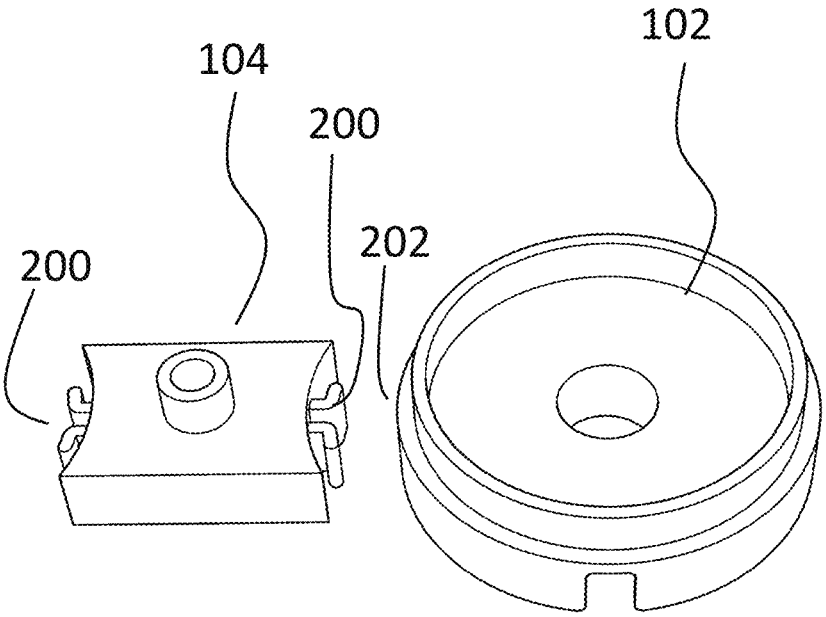
FIG. 4A is an elevated, top-view illustration, depicting the pad and link configuration and locking mechanism, according to various embodiments of the present invention.
Figure 4B:
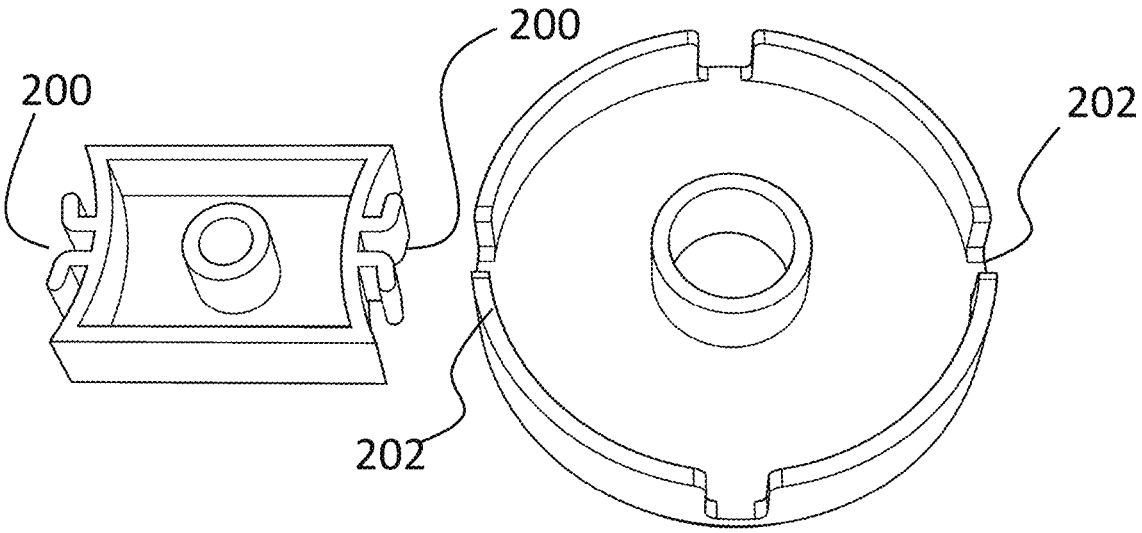
FIG. 4B is an elevated, bottom-view illustration, depicting the pad and link configuration and locking mechanism, according to various embodiments of the present invention.
Figure 5A:
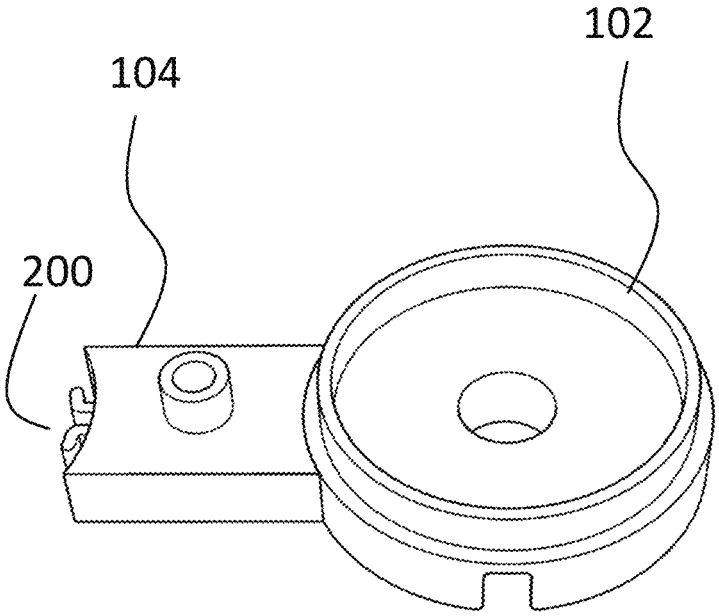
FIG. 5A is an elevated, top-view illustration depicting the pad and link configuration and locking mechanism in the locked position, according to various embodiments of the present invention.
Figure 5B:
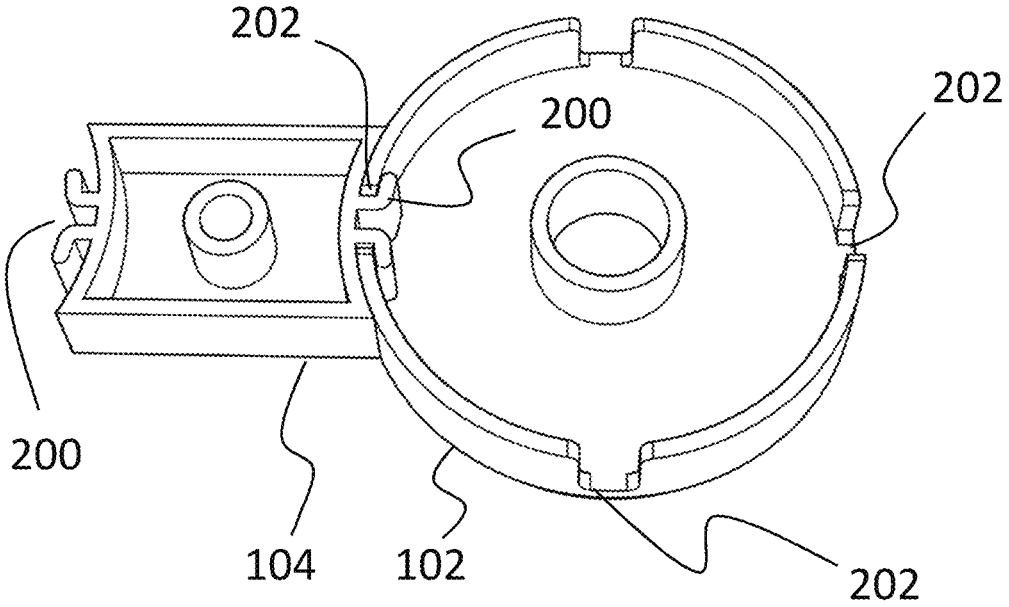
FIG. 5B is an elevated, bottom-view illustration depicting the pad and link configuration and locking mechanism in the locked position, according to various embodiments of the present invention.

For further understanding, FIGS. 4A and 4B, depict top and bottom views, respectively, of the mechanisms that snap together for the pad 102 and the link 104. In this example and as shown in FIGS. 5A and 5B, the pad connector portions 202 are attached with corresponding link connector portions 200 to securely affix the pad 102 with the links 104.

Figure 6A:
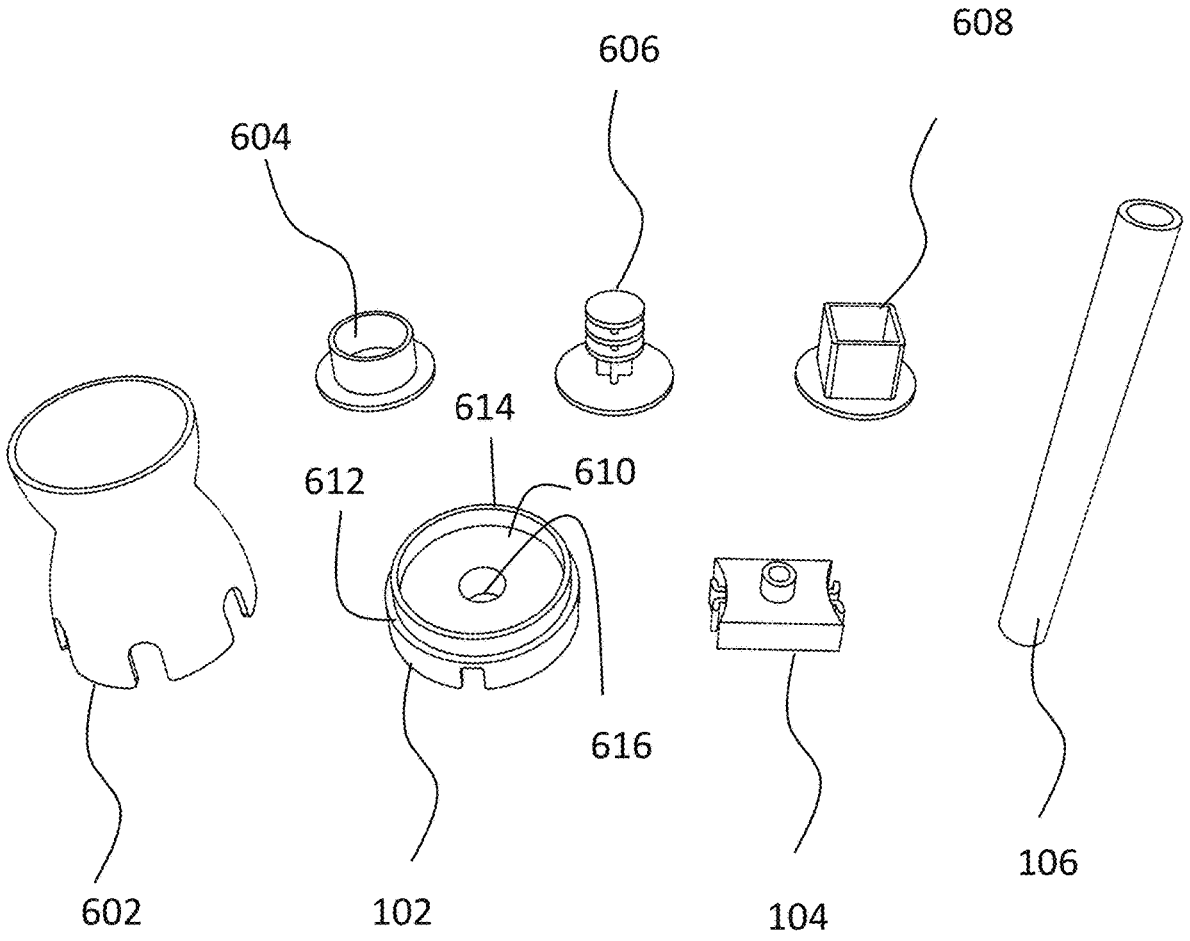
FIG. 6A is an elevated, top-view illustration of the component parts, including the pad, link, post, player markers, and modifier nodes, according to various embodiments of the present invention.

As shown in FIG. 6A and in addition to the basic structural components (i.e., pads 102, links 104, and posts 106), the grid set includes a plurality of game play components. Any suitable game play components can be included to allow user to use and play with the gaming platform. As a non-limiting example, the game play components include player markers 602 and modifier nodes. The modifier nodes are formed to connect with the pads 102 and modify the function of the pads 102 during game play. Non-limiting examples of such modifier nodes include kingerizers 604, hyper-pads 606, and blocker-boxes 608. While FIG. 6A illustrates a specific physical embodiment, similar embodiments may also extend to virtual and digital environments.

Figure 6B:
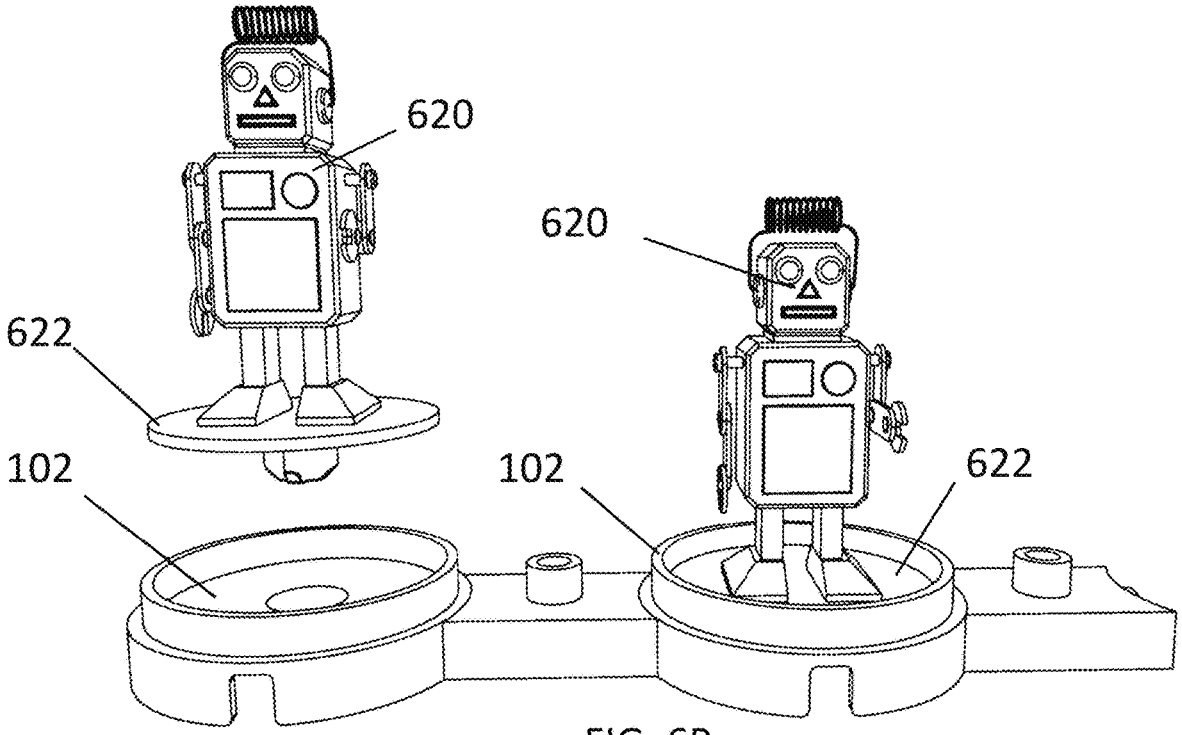
FIG. 6B is an elevated, top-view illustration of additional component parts, including figurines for attaching with the pads, according to various embodiments of the present invention.
Figure 6C:
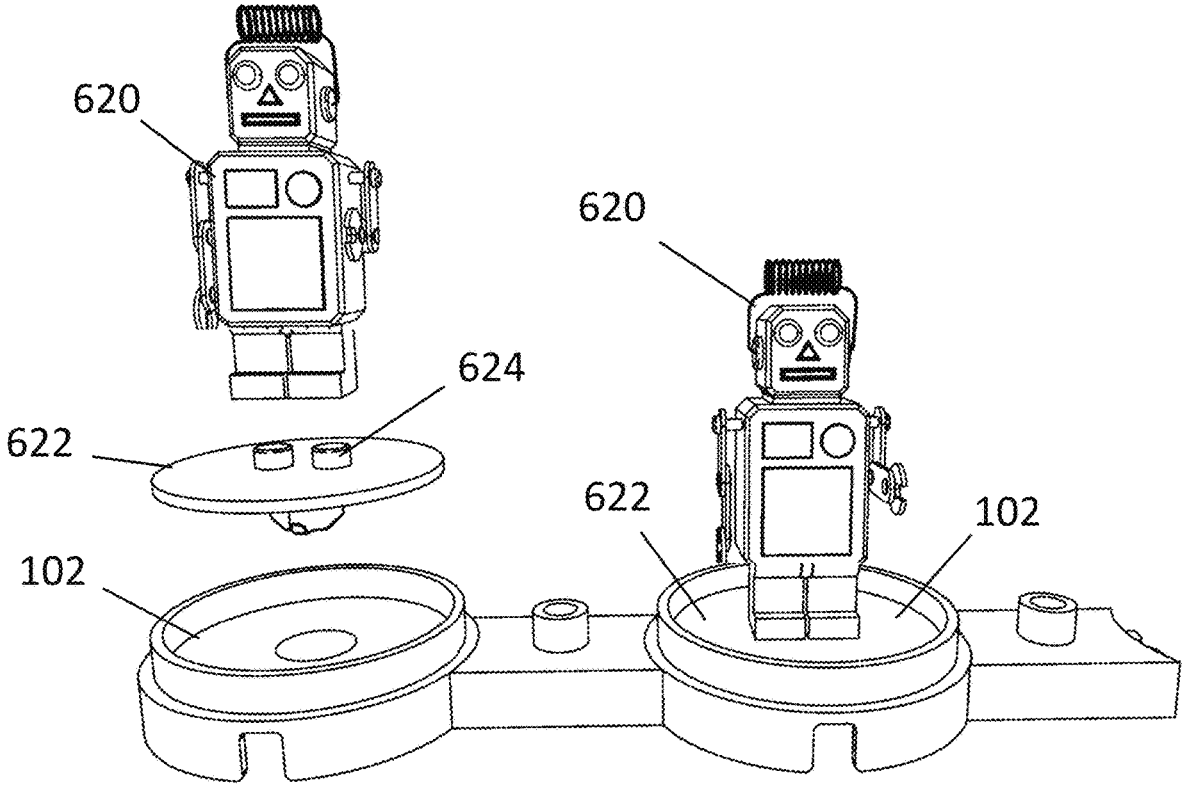
FIG. 6C is an elevated, top-view illustration of additional component parts, including figures for attaching with the pads, according to various embodiments of the present invention.

The invention according to the present disclosure can be formed to include a variety of additional components, including both play and structural components. By way of example, FIGS. 6B and 6C, depict characters or figures 620 that can be included and formed to connect with the pads 102. The figures 620 can include a base 622 attached thereto that nestles into (as depicted), or slides over, or otherwise securely connects with the pad 102. In other aspects, the figures 620 directly connect to the pads 102. In one aspect and as shown in FIG. 6C, the base 622 includes figurine connectors 624 (e.g., posts, etc.) that allow a figurine or FIG. 620 to easily connect with the figurine connector 624 and, thereby, the base 622. Although not limited thereto, the figurine connectors 624 can be selectively formed to allow a variety of modular characters or figures 622 to connect with the base 622, a non-limiting example of which includes protrusions formed to matingly engage and securely affix with holes on the feet of the figures 620. Examples of such figures 620 with holes on the feet are the figures associated with existing building block toys.

Figures 7A, 7B, 7C, 7D:
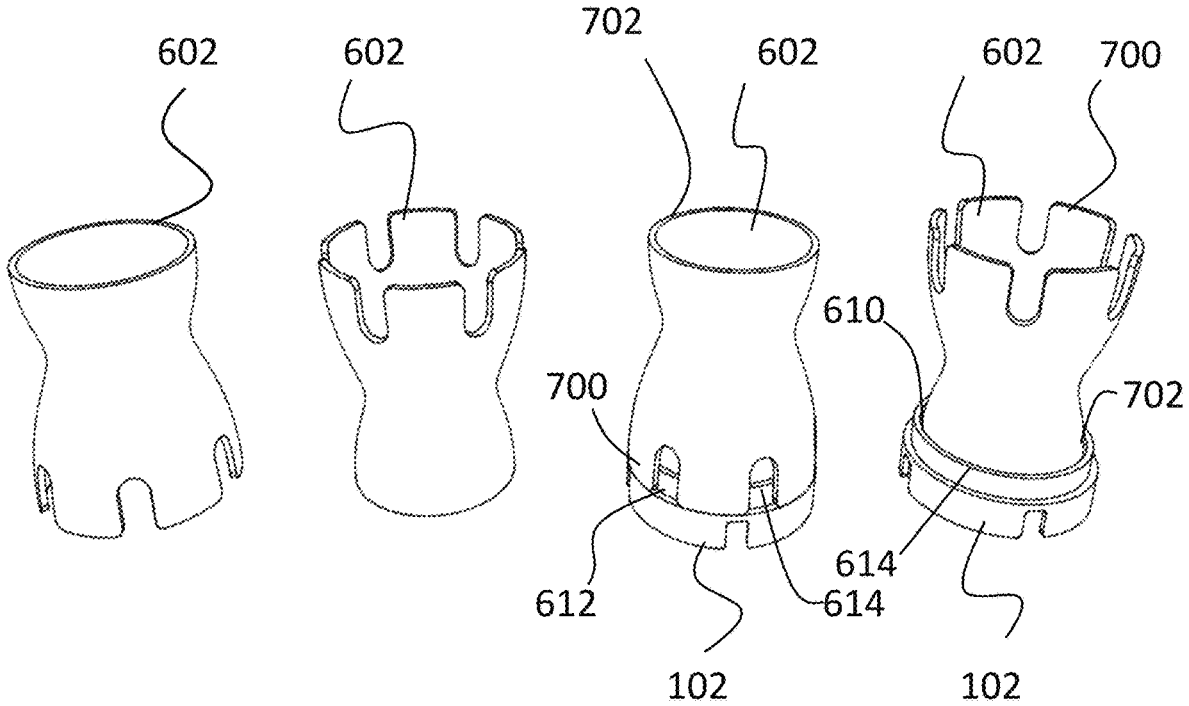
FIG. 7A is an elevated, side-view illustration depicting a player marker, according to various embodiments of the present invention.
FIG. 7B is an elevated, side-view illustration depicting the player marker being turned upside down, according to various embodiments of the present invention.
FIG. 7C is an elevated, side-view illustration depicting the player marker shown in FIG. 7A as being connected with a pad, according to various embodiments of the present invention.
FIG. 7D is an elevated, side-view illustration depicting the player marker shown in FIG. 7B as being connected with a pad, according to various embodiments of the present invention.

As noted above, in addition to the structural components, the invention includes sets of unique player markers 602 for multiple players. FIGS. 7A through 7D illustrates one desired embodiment of a player markers. Specifically, the marker 602 can be formed in any suitable shape. Desirably, the player marker 602 is shaped so that it can be connected with a pad 102 at both its top and bottom sides and is further designed to look significantly different when flipped upside down. For example, FIG. 7A depicts the mark 602 in a first state, while FIG. 7B depicts the marker 602 turned upside down into a second state (which in one game play embodiment can reflect an upgraded status). In one game play aspect, a marker 602 can be upgraded ("kinged", as shown in FIG. 7B), when it lands on a predefined location and acquires new capabilities, such as enhanced movement options (e.g., ability to move in any direction with no restrictions). Markers are also designed to nest outside FIG. 7C or inside FIG. 7D grid-set pads 102 (depending on marker orientation).

The pad 102 can be formed in any suitable shape to easily connect with the markers 602 in at least one format and, desirably, in a reversible format. Referring again to FIG. 6A, the pad 102 is shown has having a nesting portion 610 and a ledge 612, separated by a raised ridge 614. As shown in FIG. 7C, the marker 602 can be positioned such that it rests on the pad 102 by having a first end 700 slide over the ridge 614 and rest upon the ledge 612. Alternatively and as shown in FIG. 7D, the marker 602 can be flipped such that a second end 702 slides within the ridge 614 and nests within the nesting portion 610. Thus and as can be appreciated by those skilled in the art, there are a number of shapes and forms that can be implemented to allow the marker 602 to easily connect with the pad 102 in a reversible form.

Figure 8A:
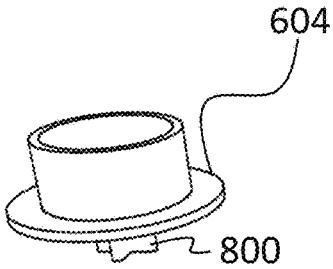
FIG. 8A is an elevated, side-view illustration, depicting a kingerizer node, according to various embodiments of the present invention.
Figure 8B:
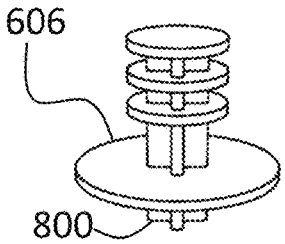
FIG. 8B is an elevated, side-view illustration, depicting a hyper-pad node, according to various embodiments of the present invention.
Figure 8C:
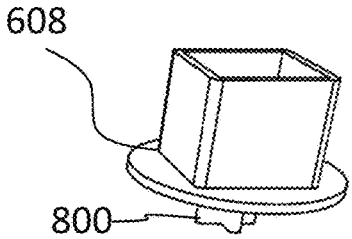
FIG. 8C is an elevated, side-view illustration, depicting a blocker-box node, according to various embodiments of the present invention.
Figure 8D:
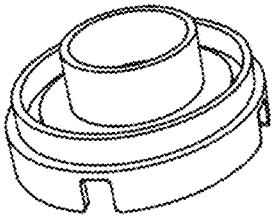
FIG. 8D is an elevated, side-view illustration, depicting a kingerizer node as connected with a pad, according to various embodiments of the present invention.
Figure 8E:
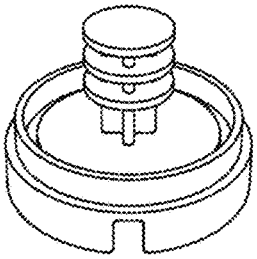
FIG. 8E is an elevated, side-view illustration, depicting a hyper-pad node as connected with a pad, according to various embodiments of the present invention.
Figure 8F:
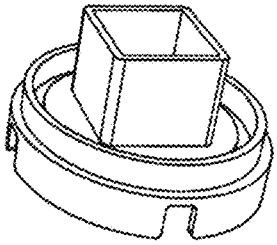
FIG. 8F is an elevated, side-view illustration, depicting a blocker-box node as connected with a pad, according to various embodiments of the present invention.
Figure 8G:
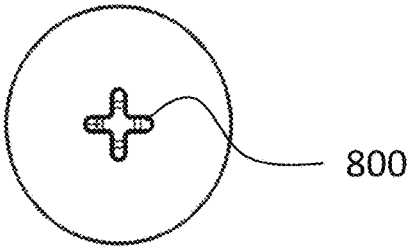
FIG. 8G is a bottom-view illustration, depicting a bottom side of a node, according to various embodiments of the present invention.

Additional custom board position placeholders ("nodes") modify the behavior of locations (pads 102) on the grid-set and can be placed on grid-set pads 102 before and/or during play. The nodes modify the function of spaces (i.e., "pads" 102) on the grid-set to transform game action at that location. FIGS. 8A through 8C depict several example embodiments of such nodes, while FIGS. 8D through 8F depict the nodes being nested within and/or otherwise connected with a pad 102. The nodes can be placed on a grid-set (via a pad 102) before and/or during play. Non-limiting examples of such nodes include the "kingerizer" node 604, the hyper-pad node 606, and the blocker-box 608 node, shown in FIGS. 8A through 8C, respectively. In one example aspect, the kingerizer node 604 may mark a player's starting home row and act as a target objective for opponents. The hyper-pad node 606 may transport a player's marker to another hyper-pad 606 in a different area of that game's grid-set(s). A blocker-box 608 node may be placed on a grid set pad 102 to eliminate that pad 102 from play. As shown in FIGS. 8D through 8F, as with player markers, nodes are designed to nest within pads 102. This aids in keeping parts and pieces from sliding off if the grid-set is moved or rotated during play. The nodes and pads can be formed in any suitable shape to allow the two to easily and securely connect with one another. As an example and as shown in the bottom-view illustration of FIG. 8G, the bottom side of any given node can be formed to include a protrusion 800. The protrusion 800 is similarly illustrated in FIGS. 8A through 8C. Referring again to FIG. 6A, the nesting portion 610 of the pad 102 can be further formed to include a node connector 616 (e.g., a recess, etc.). Thus, the protrusions 800 on the various nodes can easily rest within the node connector 616 and securely affix a node with the corresponding pad 102. Although a protrusion 800 and recessed node connector 616 are depicted, one skilled in the art can envision other shapes or embodiments in which the nodes and pads can be securely connected with one another.

Per some example game rules, players may be allocated nodes and extra structural components (pads 102, links 104, and posts 106) at the start of (or during) a specific game. This allows players the ability to change the physical grid-set and modify individual behavior of locations (pads) during play.

Figure 9:
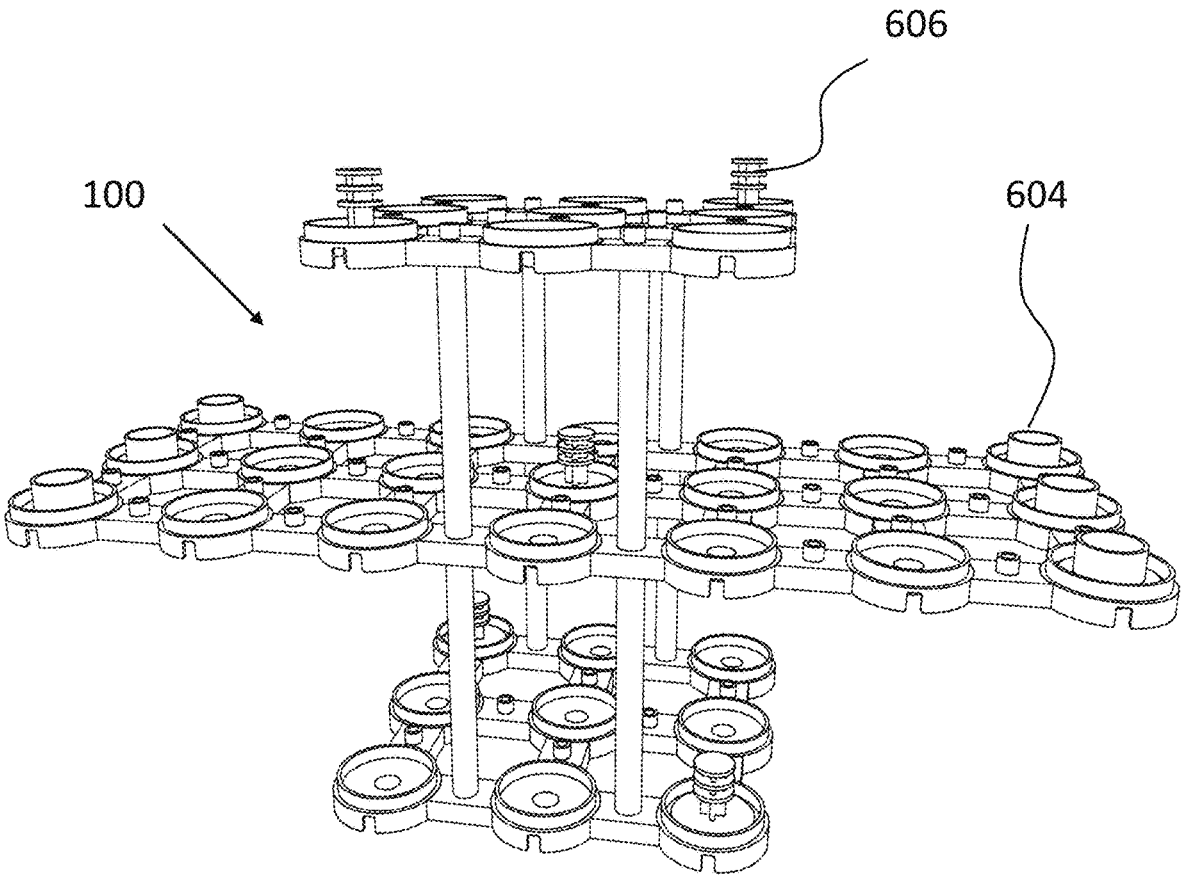
FIG. 9 is an elevated, side-view illustration, depicting an example of a grid-set as assembled for a 2-player game and as being populated with nodes and markers, according to various embodiments of the present invention.

As can be appreciated, the various game configurations that can be implemented using the present invention is endless. By way of example, FIG. 9 is an elevated, side-view illustration, depicting an example of a grid-set 100 as assembled for a 2-player game and as being populated with nodes 604 and 606.

Figure 10:
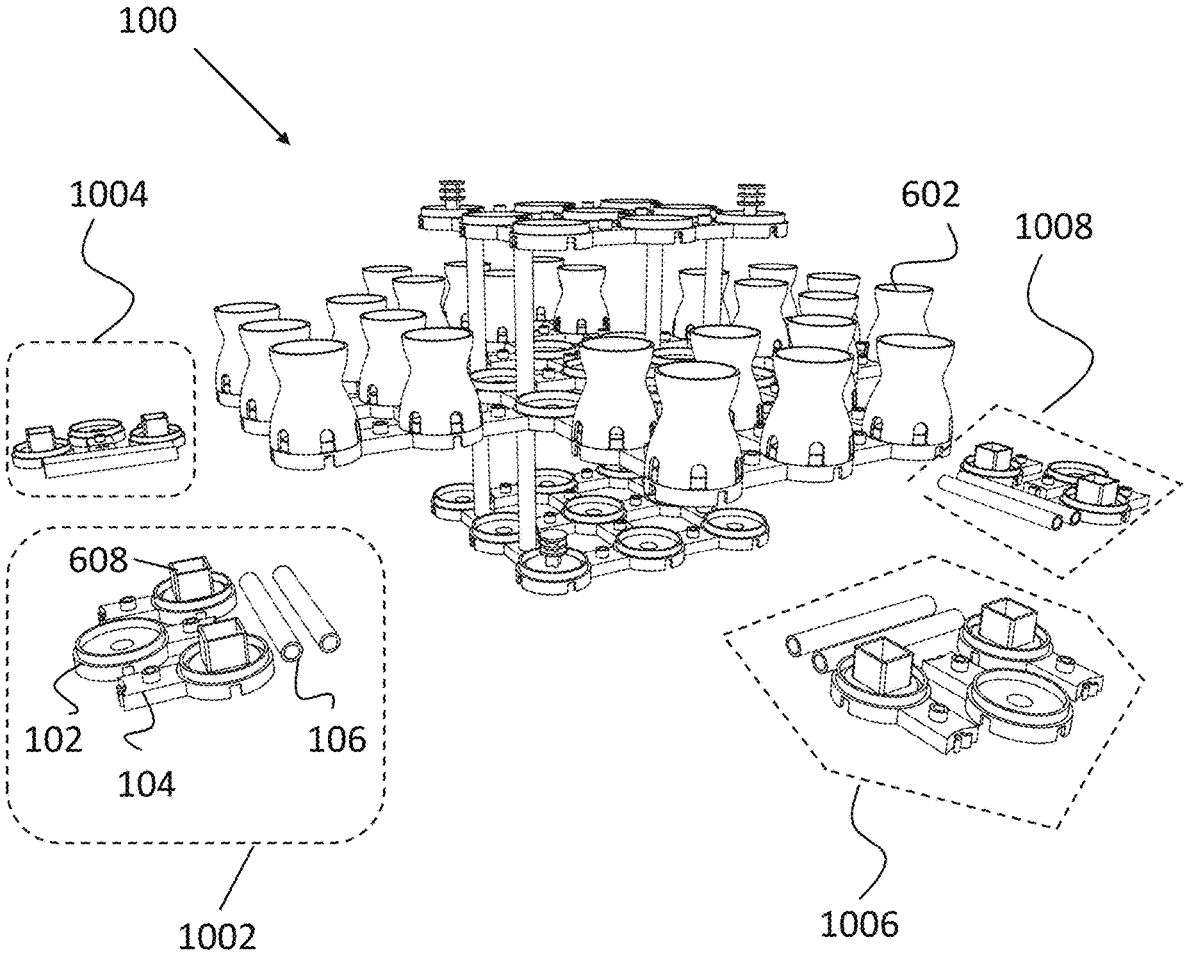
FIG. 10 is an elevated, side-view illustration, depicting an example of a grid-set as a start of a 4-player game, according to various embodiments of the present invention.
Figure 11:
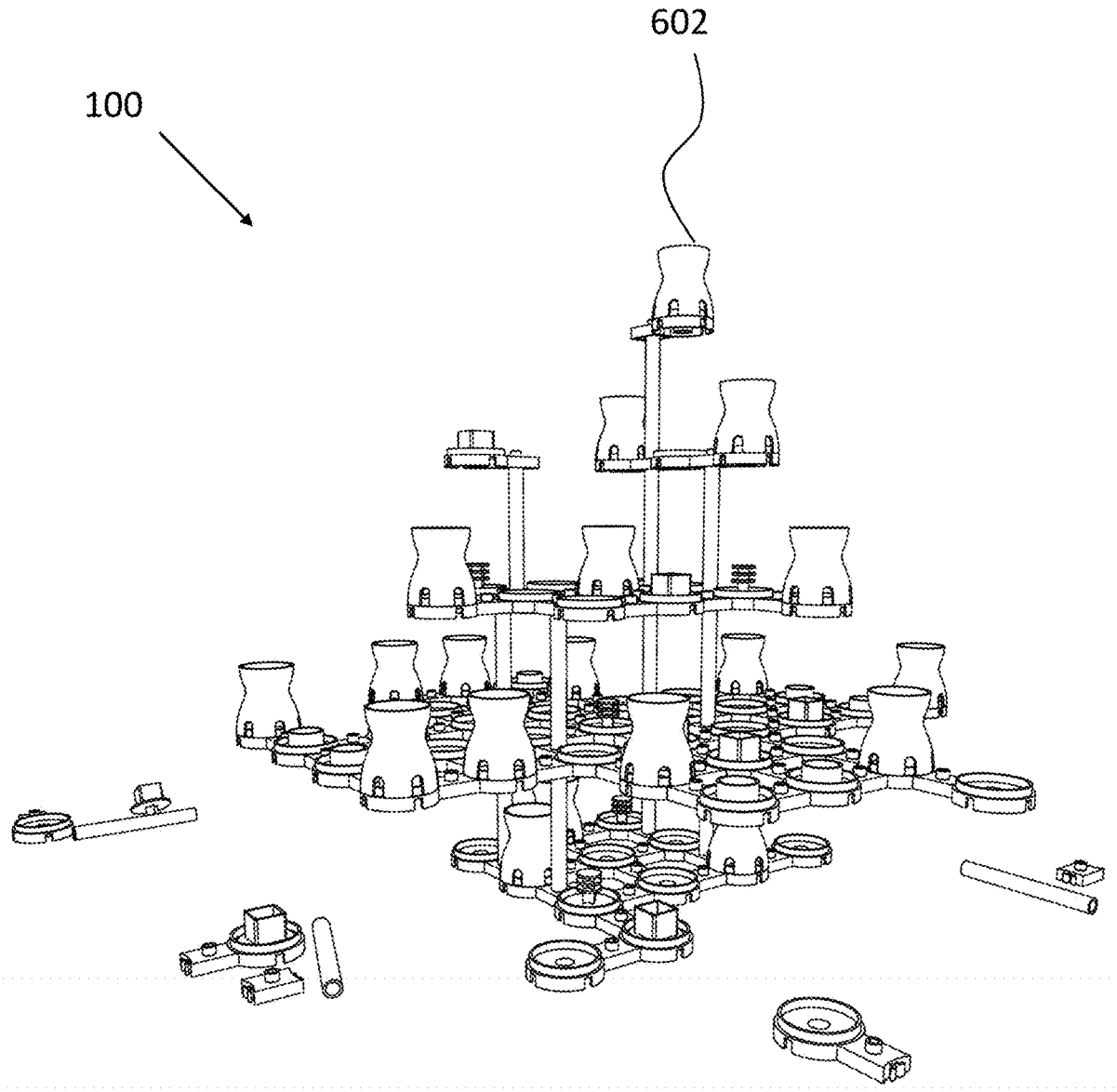
FIG. 11 is an elevated, side-view illustration, depicting a sample game at a later stage of play than the start as originally depicted in FIG. 10.

As yet another example, FIG. 10 illustrates a sample completed grid-set 100 with player markers 602 arranged for the start of an example 4-player strategy game. A collection of extra nodes and structural components (pads 102, links 104, posts 106 and blocker-box nodes 608 (in this example)) have been allocated to each player 1002, 1004, 1006, 1008 for modifying the grid-set 100 during a game (according to one example game play). FIG. 11 revisits the same sample game previously shown in FIG. 10 at a later stage of play, where markers 602 have been moved or captured and significant grid-set 100 additions and modifications have been made by players (or events) during play. Though the start of a specific game may always look the same in one embodiment, the physical game structure (and play action) can dynamically and dramatically change during play creating an entirely unique experience.

Figure 12:
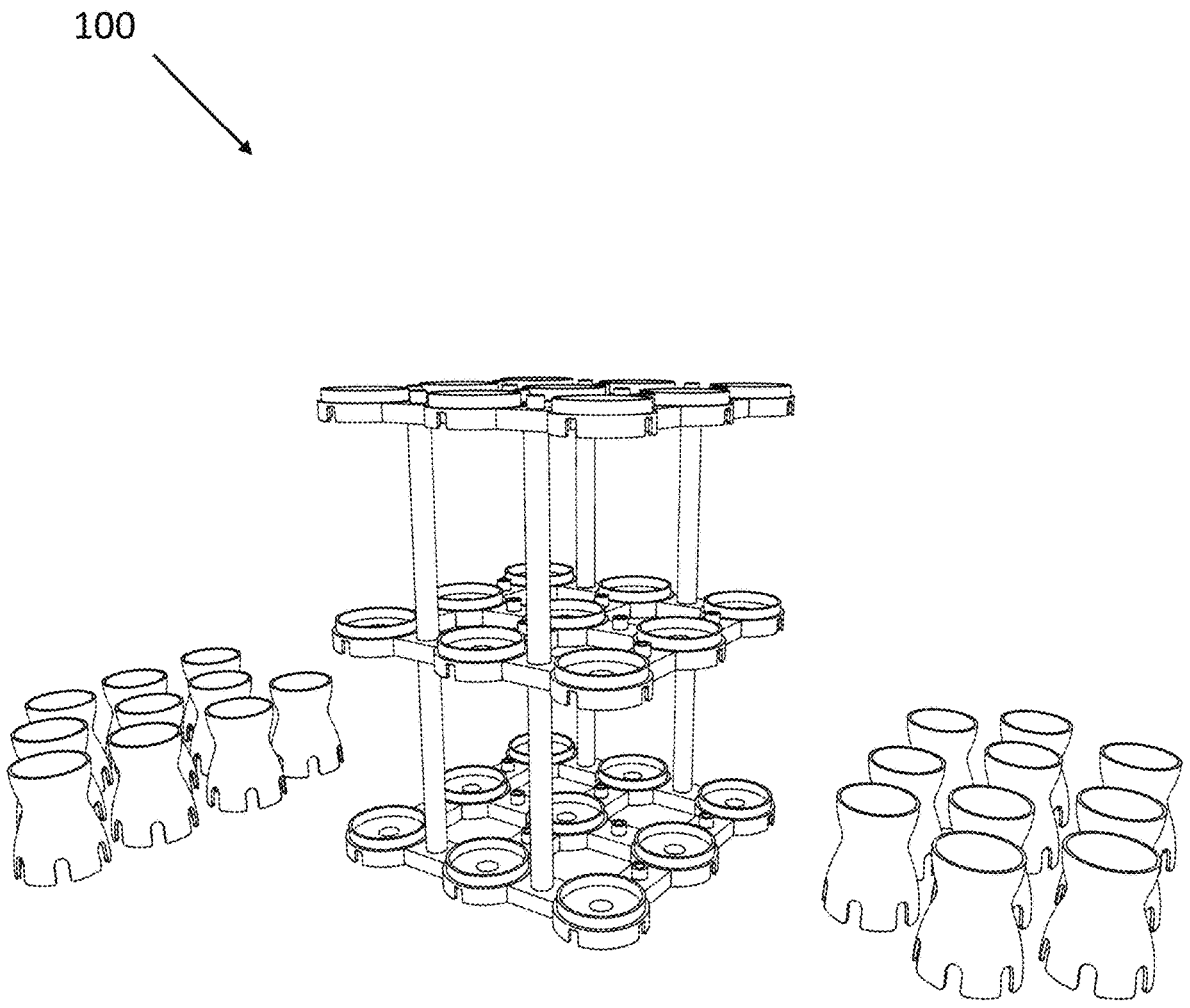
FIG. 12 is an elevated, side-view illustration, depicting of an additional sample grid-set construction on which a variety of games can be played, according to various embodiments of the present invention.
Figure 13:
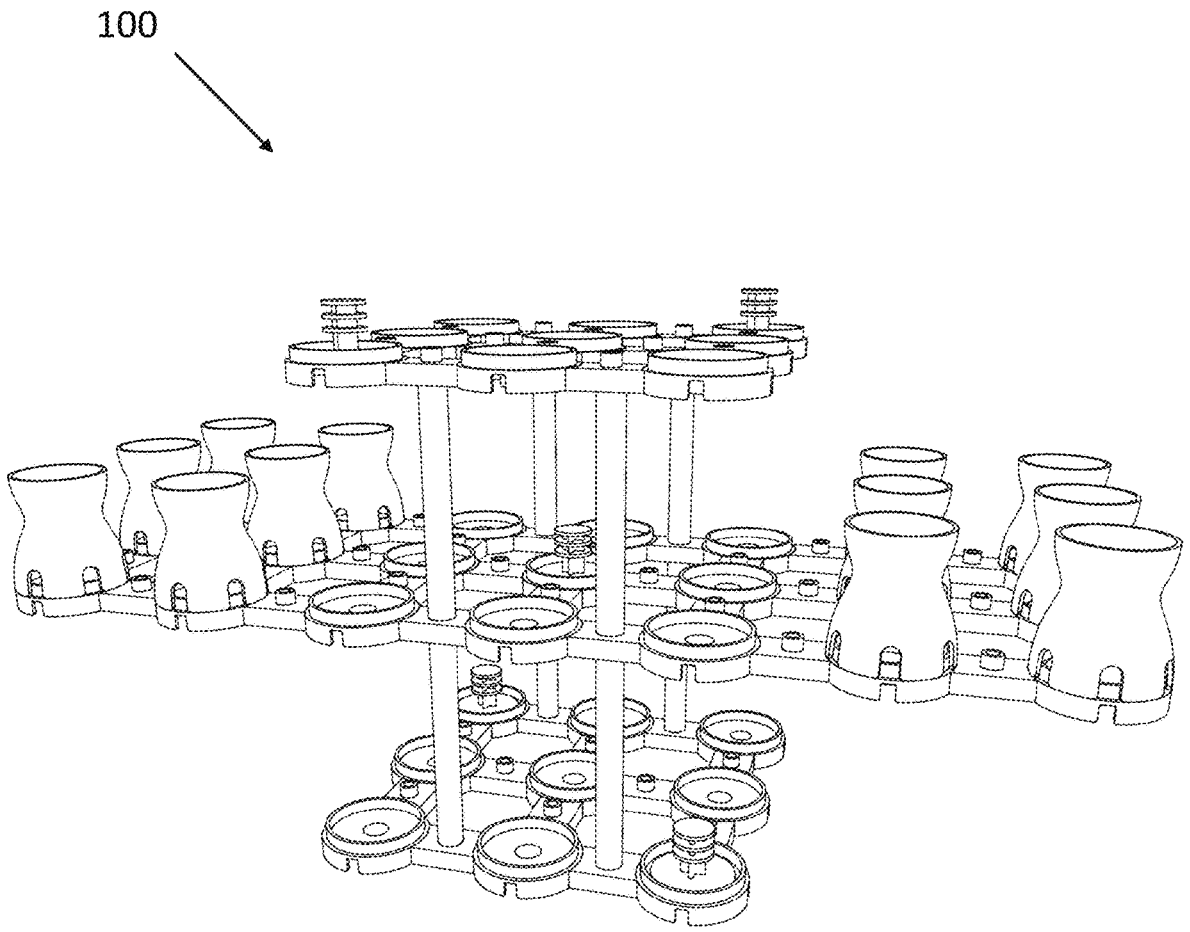
FIG. 13 is an elevated, side-view illustration, depicting a sample game at the beginning of the 2-player game as depicted in FIG. 12.
Figure 14:
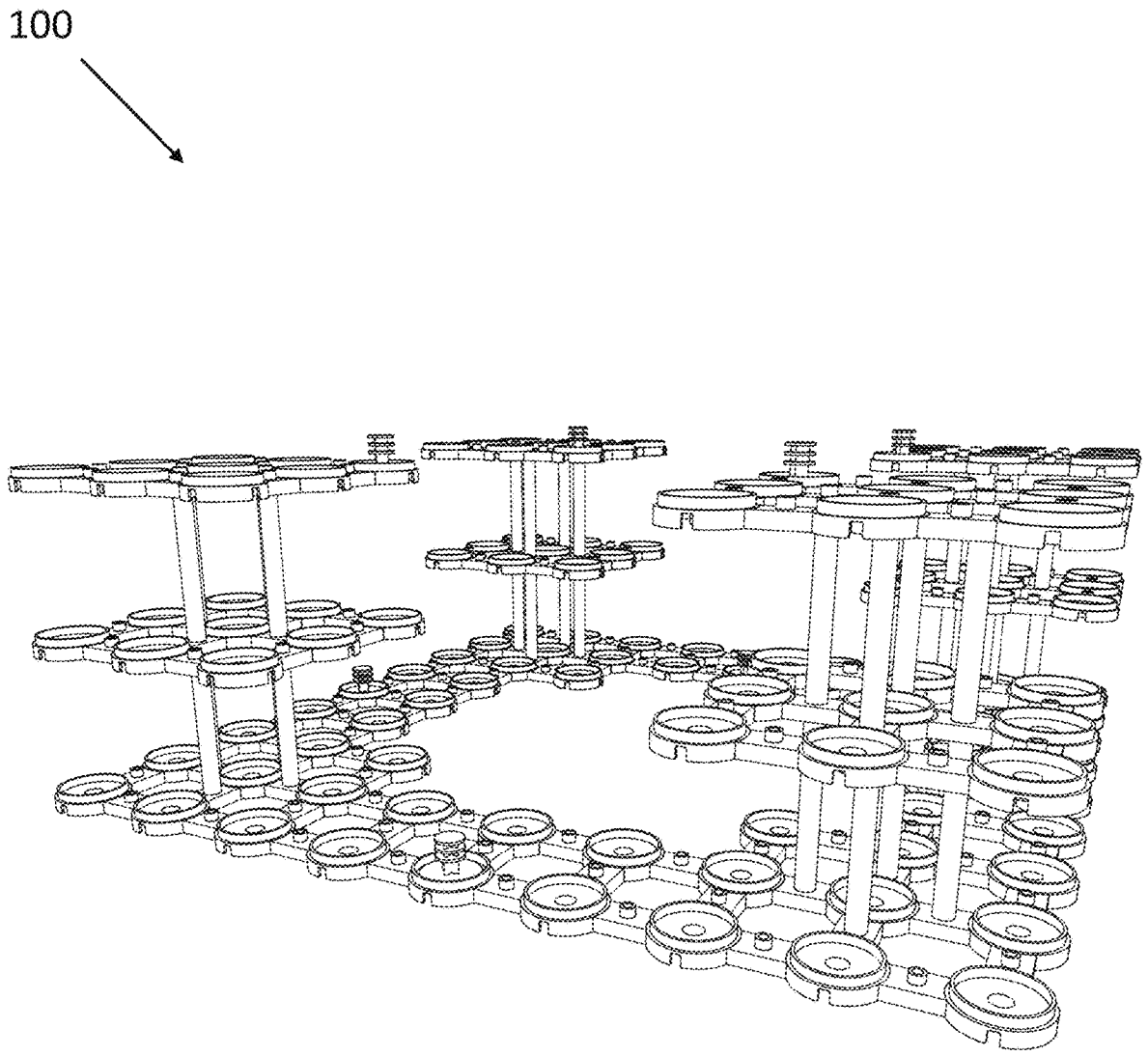
FIG. 14 is an elevated, side-view illustration, depicting an additional sample grid-set construction on which a variety of games can be played, according to various embodiments of the present invention.
Figure 15:
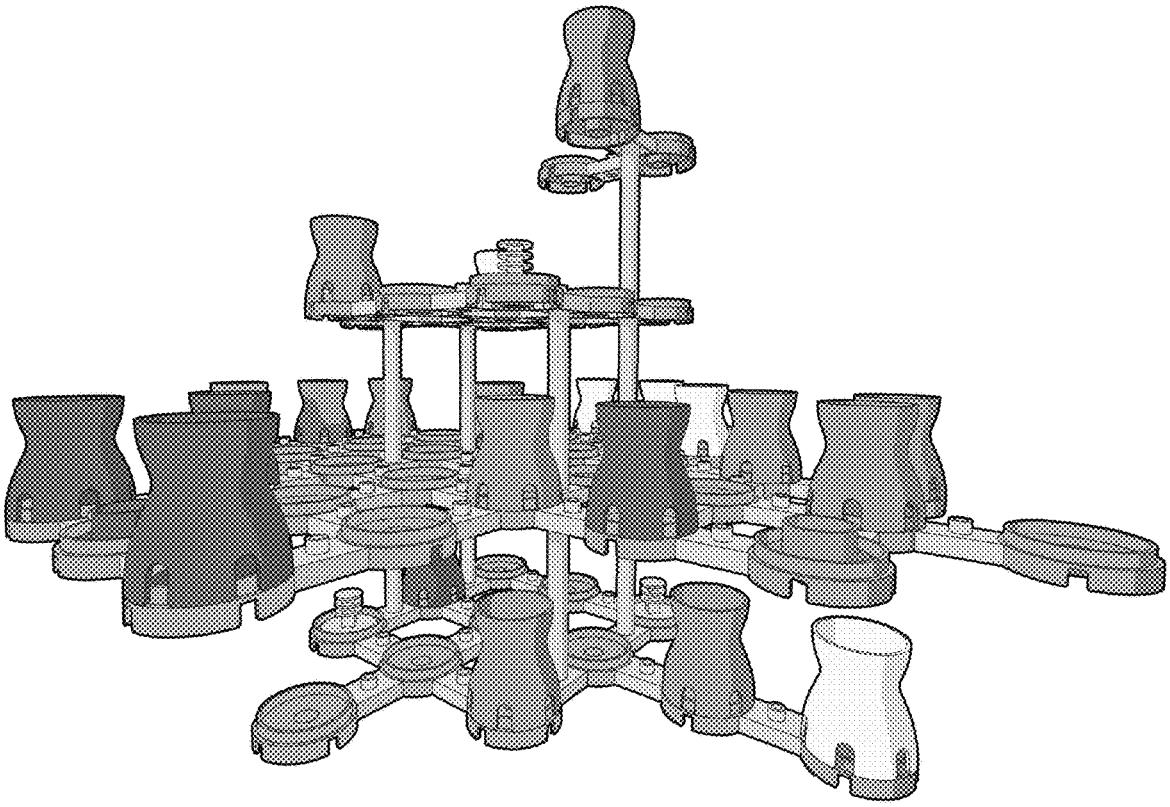
FIG. 15 is an illustration depicting rules and example game play using the gaming platform according to various embodiments of the present invention.
Figure 28:
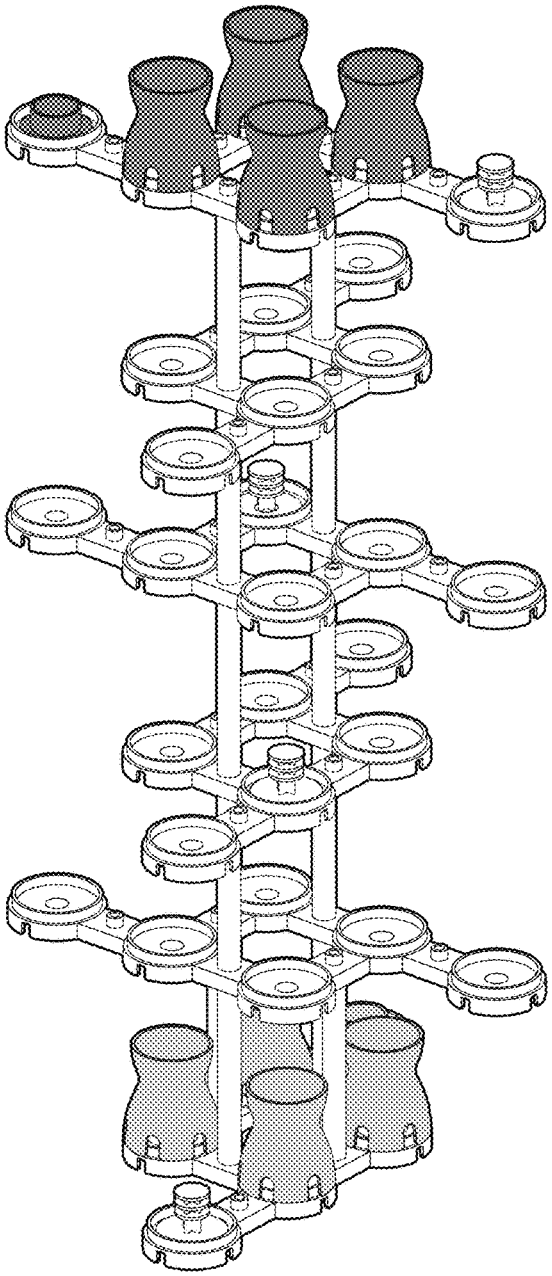
FIG. 28 is an illustration depicting rules and example game play using the gaming platform according to various embodiments of the present invention.

In other words, the grid-sets 100 are highly customizable and extensible. For example, FIG. 12 and FIG. 13 show the flexibility of grid-set 100 constructions on which a variety of games may be played for a 2-person gameplay. Multiple game types have been defined in several example embodiments and include game rules and recommended grid-set configurations. FIG. 14 is yet another example of a grid-set 100 construction used for 4-players to play a variety of games.

As noted above, a variety of game plays patterns can be implemented using the gaming platform and grid-set 100 as described in this disclosure. For example, player markers 602 can generally move in three dimensions, including up, down, sideways, and diagonally across multiple levels. Movement options may vary (or change during play) and are defined explicitly in the rules for various specific games. In games where players capture opponents, markers 602 may jump over opponent markers 602 to capture them. Different player markers 602 may be color coded to allow the various players to identify their specific markers 602. For example, a first player may start with blue markers 602 while a second player starts with green markers 602 (or any other desired color or markings as implemented or desired). A multi jump move can capture multiple opponent markers 602. A unique "kamikaze" move allows a marker 602 to jump outside the grid-set 100 in a sacrificial move that captures an opponent but also eliminates the attacking player's marker 602.

The modifier nodes 604, 606, and 608 placed on grid-set pads 102 alter the game play by extending or restrict marker 602 movement at those pad 102 locations. For example, a marker 602 landing on a kingerizer node 604 may be upgraded with enhanced capabilities. A marker 602 landing on a hyper-pad 606 node may be transported across a grid-set 100 to another hyper-pad 606 location. A blocker-box 608 node restricts that particular pad 102 from play by blocking or otherwise preventing a marker from being able to being positioned on that particular pad 102.

At the start of a turn, a player may decide not to move a marker 602 but instead extend the grid-set 100 (if they were allocated extra structural grid-set parts) or modify existing grid-set pads 102 with modifier nodes 604, 606, and 608 (if available for that game). This allows a grid-set 100 to change dynamically during a game enabling alternate avenues of play and strategy.

A variety of games can be played on the grid-sets 100. Instructions and rules for several variations are included and provided with the invention during packaging and sale. Further, additional add-ons and kits can further extend the functionality and variety of games. Thus, the gaming platform enables an extensible variety of games as well as opportunities for further customizing board-sets, game types, rules, player pieces, 3D printable extensions, and digital implementations. Although this invention has been described in specific detail with reference to the disclosed embodiments, it will be understood that variations and modifications may be effected within the spirit and scope of the invention.

As noted above, the invention of the present disclosure can be used for a variety of game play and patterns. As a non-limiting example, FIGS. 15-27 describe and illustrate an example of rules and game play using the gaming platform described herein.

As shown and described in FIGS. 15 through 27, players construct a gaming platform grid-set using predefined grid-set designs or designs of their own. A specific game (predefined or player-invented) is chosen and player markers are arranged appropriately on the grid-set. Additional grid-set structural parts and modifier nodes may be allocated to players (before the game starts) so that players can modify the grid-set structure and modify grid-set locations during play. Play commences according to specific game rules and play ends when time runs out, goals are achieved, a stalemate is reached, or a single player remains.

One non-limiting example of game play is depicted in FIGS. 15 through 27 and referred at as the Matrix rules. In this scenario, two players are identified as Player A and Player B. The players review which of the game-play options are available (a) 'last man standing' and (b) a time game using points. For example, the players decide to play a game using the 'last man standing' rules and play as follows.

Setup: The two players construct a two-player grid-set in preparation for their game. They build using the three grid-set 'structural' parts: pads, posts and links. Once the grid-set is constructed, the players place a series of 'kingerizer' parts along the starting home-row to indicate where they started and indicate the opponent's destination. Next, the players place their own team 'markers' on top of their 'kingerizers' and in a configuration as stipulated by the rules. The markers are placed in the 'pawn' orientation, which is indicated by the smaller top section. Next, the players locate five 'hyper-pad' parts on the grid-set.' Finally, the players distribute parts and each receive ten (10) extra parts for building during the course of a game. In one manifestation, these ten parts consist of three pads, three links, two posts, and two blocker-box nodes.

For further understanding and illustrative purposes, provided below is an example game play describing the various actions by players during an example game. Although specific players actions are described, it should be understood that the invention is not intended to be limited thereto as there are other play actions and patterns that can be implemented by the players. In this non-limiting example, the players proceed with the example game play and turns as follows:

GAME PLAY>Turn 1:

i. Player A reviews their options to begin.

ii. They can move any of their six markers.

iii. Also, a marker can move one pad in any direction except for backwards, towards their starting home-row. Legal moves include sideways, diagonally, and both sideways and diagonally to other levels, all providing they are within one pad of the beginning position.

iv. One example is their three 'back row' markers. These are allowed to do a 'leap-frog' move, or jump their own team to progress faster.

v. Another example is their front row marker in the center. On the same level, it can move to three spaces: forward or diagonally left or right. They can also move up a level, to three different pads. They can also move down a level to three different pads. They have nine (9) different movement options.

vi. Player A moves their center front marker up one level and to the left corner pad.

GAME PLAY>Turn 2:

i. Player B reviews their options.

ii. They decide to move their front right marker up one level to the top-right pad, where there is a 'hyper-pad' node located.

iii. The 'hyper-pad' grants them the ability to 'beam-out' to any other 'hyper-pad' on the entire grid-set playing area.

iv. Player B moves their marker to the lower-level hyper-pad, located on the right side.

GAME PLAY>Turn 3 i. Player A reviews their options and opts not to move any markers.

ii. Instead, they build and 'add-a-pad' to the set. It is located on the lower level in the center position, directly under the Player B grouping.

GAME PLAY>Turn 4 i. Player B opts to move one of their back-row markers.

ii. They move the back, left marker and jump the front row center marker and then land in middle level, right side, three pads forward from the back row.

iii. This is a legal 'leap-frog' move.

GAME PLAY>Turn 5 i. Player A opts to move their furthermost marker from its lower level position, up one level, to the center pad.

ii. This move does not go backwards, but sideways with respect to their original starting/home-row. It is therefore a legal move.

GAME PLAY>Turn 6 i. Player B opts to jump the further-most marker from Player A.

ii. They jump their marker over their opponent and thereby capture them.

iii. The captured Player A marker is removed from the grid-set and all further game play.

GAME PLAY>Turn 7 i. Player A opts to neither move or build, but instead block their opponent with a 'blocker-box' move.

ii. They do this by placing their 'blocker-box', stored off to the side of the game, onto the grid-set. It can be placed anywhere there is an open and 'un-blocked' pad.

iii. They place the blocker-box on the top level, center pad.

iv. This 'blocker-box' is eliminated the pad from all further use. No markers can land on it and all markers must go around, including the player who first placed it.

v. The 'blocker-box' cannot be moved.

GAME PLAY>Turn 8 i. Player B opts to move their further-most marker one pad up and diagonally, to the top level.

ii. They are now right next to one of player A's markers.

GAME PLAY>Turn 9 i. Player A does not see the impending capture, as they are located on the top row and in a corner position.

ii. Instead, they move their back-row, right-side front row marker forward one pad.

GAME PLAY>Turn 10 i. Player B now proceeds to capture Player A, located on pad in front of them.

ii. However, they have nowhere to land, which is typically required by the rules.

iii. Instead, they opt to use the sacrifice move called 'kamikaze.' Player B jumps over player A and both are removed from the game.

iv. Normally, each jump consists of three points which form a straight line. The points are represented by (1) $1^{st}$ marker starting position, (2) $2^{nd}$ marker being captured and (3) $1^{st}$ marker landing on an open and empty pad.

v. To use the kamikaze move, both markers must be on the same level and the initiating marker cannot be moving backwards.

GAME PLAY>Turns 11 through 17—Continues as Players build horizontally and/or vertically to the grid-set and progress across the grid-set.

GAME PLAY>Turn 18 i. Player B has progressed to Player A's side of the grid-set.

ii. They move to a pad that has Player A's 'kingerizer,' or home-row marker.

iii. Player B is automatically promoted from a pawn a king. Their marker is flipped over to indicate this new designation.

iv. The marker is now in the 'king' orientation, which is indicated by the larger top section.

v. The king marker has the ability to move in any direction with no restrictions. They also get two separate moves in a row.

GAME PLAY>Turns 19 through 23—Continues as Players build horizontally and/or vertically to the grid-set and progress across the grid-set.

GAME PLAY>Turn 24 i. Player A (as a king) jumps and captures a Player B marker (moving horizontally) on the lower level.

ii. When they land, they notice another Player B marker directly above them.

iii. Using a 'multi-jump' move, Player A captures the second Player B marker (moving vertically) and lands on the top level.

iv. This is known as the 'multi-jump' move. At the end of any jump, a player can capture more an additional opponent if there are other jump-moves immediately present.

GAME PLAY>Turn 25 i. Player B (as a king) is on the lower level, next to a hyper-pad. They jump on the hyper-pad and opt to go to a top-level hyper-pad.

ii. Next to that top-level hyper-pad is Player A.

iii. Player B, with one remaining move, jumps and captures Player A.

iv. This is legal because a hyper-pad move is 'free' and does not count as a move.

GAME PLAY>Turns 26 through 29—Continues as Players build horizontally and/or vertically to the grid-set and progress across the grid-set.

GAME PLAY>Turn 30 i. Player B has two remaining markers and Player A has only one.

ii. Player B is able to get in position to jump the last Player A marker.

iii. Player B, as the 'last man standing' is the winner of the game.

Another non-limiting example of game play and rules using the gaming platform is depicted in FIGS. 28 through 34. Thus, as can be appreciated, there are several games that can be implemented using the gaming platform according to the present disclosure.

Some people may enjoy the construction aspect of building physical (or virtual) grid-set structures without ever playing any games on those platforms. Others may simply enjoy inventing (and contributing) additional games and rules without ever designing or building grid-sets. Others still may enjoy simply watching games or tournaments. For example, gaming conventions may run local and distributed tournaments using this gaming platform.

In another aspect, the gaming platform and game play can be digitized such that online distributed social gaming may be played with human and non-human (AI) opponents and team members. Digital games may be played, and virtual grid-set editors may be used to design and publish unique grid-sets. Further, large scale virtual grid-sets with multi-player armies may be engaged in virtual game space where a limitation of physical components is not a factor.

In yet another aspect, crowdsourced contributions may establish the best, biggest, most creative grid-set designs. Awards and records may be awarded for the largest, longest, most distributed, creative games played on this invention's physical or virtual gaming platform. Schools, clubs, and organizations may employ educational learning opportunities using the modular and logical aspects of this invention.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A three-dimensional gaming platform, comprising:

a plurality of pads, each pad being formed to connect with a horizontally adjacent pad via a link;

wherein each pad includes at least one pad connector component;

wherein each pad includes a nesting portion that is formed to securely hold a player marker upon the pad;

a plurality of links, each link having a top and bottom post connector and at least two link connector components, the link connector components being formed to connect with a pad connector component to horizontally affix a pad with a link;

a plurality of posts, each post being formed to vertically connect two links, thereby connecting at least two pads vertically to form a grid-set in which the at least two pads can be positioned vertically with the nesting portions being positioned vertically with respect to one another;

wherein each post is formed to connect with both a top post connector and a bottom post connector to vertically connect two of the plurality of links and, in doing so, vertically connect the at least two pads when attached with a link;

a plurality of player markers, each player marker being formed to reversibly attach with a pad;

a plurality of nodes, each node being formed to connect with a pad;

wherein the plurality of nodes include at least one blocker node, the blocker node being shaped and sized to prevent a marker from sliding over the blocker node and rest upon a pad;

wherein the nesting portion of each pad is surrounded by a raised ridge, and further comprising a ledge such that the nesting portion and ledge are separated by the raised ridge; and wherein each marker is formed to include a first end and a second end such that each marker can rest on the pad in two configurations, wherein in a first configuration, the first end slides over the raised ridge and rests upon the ledge, and wherein in a second configuration, the second end slides within the raised ridge and nests within the nesting portion.

2. The three-dimensional gaming platform as set forth in claim 1, further comprising a base formed to connect with a pad, the base having one or more figure connectors for securely affixing a figure with the base.

3. A three-dimensional gaming platform, comprising:

a plurality of pads, each pad being formed to connect with a horizontally adjacent pad;

a plurality of posts, each post being formed to vertically connect at least two pads, thereby forming a grid-set;

wherein each pad is formed to have a nesting portion surrounded by a raised ridge, and further comprising a ledge such that the nesting portion and ledge are separated by the raised ridge; and a plurality of player markers, each player marker being formed to reversibly attach with a pad;

wherein each marker is formed to include a first end and a second end such that each marker can rest on the pad in two configurations, wherein in a first configuration, the first end slides over the raised ridge and rests upon the ledge, and wherein in a second configuration, the second end slides within the raised ridge and nests within the nesting portion.

* * * * *